United States Patent [19]

Stern et al.

[11] 4,062,075

[45] Dec. 13, 1977

[54] BED ARRANGEMENT

[75] Inventors: Robert G. Stern, St. Louis; Larry D. Mitchell, Manchester, both of Mo.

[73] Assignee: Affiliated Hospital Products, Inc., St. Louis, Mo.

[21] Appl. No.: 708,126

[22] Filed: July 23, 1976

Related U.S. Application Data

[60] Division of Ser. No. 389,983, Aug. 20, 1973, Pat. No. 3,972,081, and a continuation-in-part of Ser. No. 499,082, Aug. 20, 1974, abandoned.

[51] Int. Cl.[2] ..... A61G 7/10

[52] U.S. Cl. ..... 5/63; 5/68

[58] Field of Search ..... 5/62–69; 248/394

[56] References Cited

U.S. PATENT DOCUMENTS

| | | | |
|---|---|---|---|
| 3,593,350 | 7/1971 | Knight | 5/66 |
| 3,644,945 | 2/1972 | Goodman | 5/68 |
| 3,710,404 | 1/1973 | Peterson | 5/68 |
| 3,724,004 | 4/1973 | Behrens | 5/68 |
| 3,958,283 | 5/1976 | Adams et al. | 5/68 |
| 3,972,081 | 8/1976 | Stern et al. | 5/68 |

*Primary Examiner*—Casmir A. Nunberg
*Attorney, Agent, or Firm*—Reginald F. Pippin, Jr.

[57] ABSTRACT

A bed having a torque-compensated parallelogram lifting arm arrangement. The bed has a subframe vertically adjustable by the parallelogram lifting arm arrangement and thereby retains a level relationship at all height adjustment levels.

An articulated mattress support surface is provided, which is formed by articulated pivotally interconnected head or back, seat, thigh and leg sections mounted on the level vertically adjustable subframe. The seat section is double-pivoted, and enables simple and effective Trendelenburg and Reverse Trendelenburg positioning independent of any position of the height-adjustable supporting subframe. The seat, thigh, and head sections are articulated by cam and cam follower drive arrangements. Selective pivot defeat means are provided to enable selective pivotal lowering of the thigh and head or back sections without pivoting the seat section, and independent of the supporting subframe position, enabling simple and effective hyperextension positioning. The back and thigh sections may be pivoted up and down to at and above horizontal by patient control; other movements and positioning are nurse-controlled by a foot end mounted nurse control panel. A cantilever bumper, having wall engaging rollers, is pivotally mounted at the head end of the bed on the base, and is automatically lowered when the bed height is lowered to assure spaced positioning of the bed from a wall. The bumper self-retains its set angular position by frictional action at its pivot mounting connection with the base. Sockets are provided on the vertically adjustable always level subframe at the corners and midsection for mounting IV rods, fracture frames, patient control pendant holders, etc. Vertical height adjustment and all mattress support surface articulation action can be selectively effected by electric motor control or hand crank.

37 Claims, 29 Drawing Figures

301
308
303
310
318
340
309
302
304
308A'
321R
311
319
336
337
53
308A'''
308'''

308'
338

BED ARRANGEMENT

This application is a division of copending application Ser. No. 389,983, filed Aug. 20, 1973, now U.S. Pat. No. 3,972,081, and is a continuation-in-part application Ser. No. 499,082, abandoned filed Aug. 20, 1974, and is filed pursuant to and as a result of the requirement for division in parent application Ser. No. 389,983.

This invention relates to bed arrangements, and more particularly to hospital type beds, in which a mattress-supporting surface is selectively articulated and/or the mattress-supporting surface is selectively raised and lowered.

It is a feature of the invention to provide a compensating parallelogram-type raising and lowering arrangement which, contra to conventional parallelogram-type arrangements, provides good mechanical advantage in the lowered or closed zone of the parallelogram arms, with consequent lowered power requirements and with more even over-all mechanical advantage and power requirements over the range of raising and lowering movement of the parallelogram arms.

A still further feature is the provision of a vertically adjustable bed which employs a pivoted parallelogram height adjustment arrangement and which provides relatively good lateral stability in its various height adjusted positions.

It is a feature to provide a bed with a compensating parallelogram type raising and lowering arrangement in which the mattress-supporting surface can be put into straight line Trendelenburg and straight line Reverse Trendelenburg, and it is a further feature that Trendelenburg and Reverse Trendelenburg and Hyperextension can be obtained at any bed height.

According to another feature all of the spring functions can be obtained simultaneously while the bed is raising or lowering.

Another feature is that none of the spring- or mattress-supporting surface articulation functions and treatment positions affect the horizontal relationship of the mattress support subframe which is raised and lowered by the compensating parallelogram-type raising and lowering arrangement, with the advantage that the IV rods, fracture frames, and head and foot panels all remain in their upright functional positions without adversely affecting the surrounding equipment, furniture, and walls.

According to still another feature, all of the mattress articulation or treatment positions can be obtained by actuating the appropriate articulation-effecting switches regardless of the position of the spring or bed height, the advantage being that none of the articulation treatment positions have to be obtained by means of a manual crank, and the bed does not have to be adjusted to any particular height or moved away from the wall, saving time and eliminating long detailed instructions.

A further feature is that the simplicity of operation reduces likelihood of mistakes and confusion on the part of the operator.

According to another feature, the controls are all placed in a convenient accessible location.

Still another feature is that all of the bed functions can be operated by means of an accessory crank handle in case of power failure.

A still further feature is that the back section, thigh section, and leg section can be manually pivoted up out of the way for cleaning and maintenance.

Another feature is the great stability of the bed at all adjustment heights.

Still other objects, features and attendant advantages will become apparent to one skilled in the art from a reading of the following detailed description, taken in conjunction with the accompanying drawings, wherein.

Figure 1:
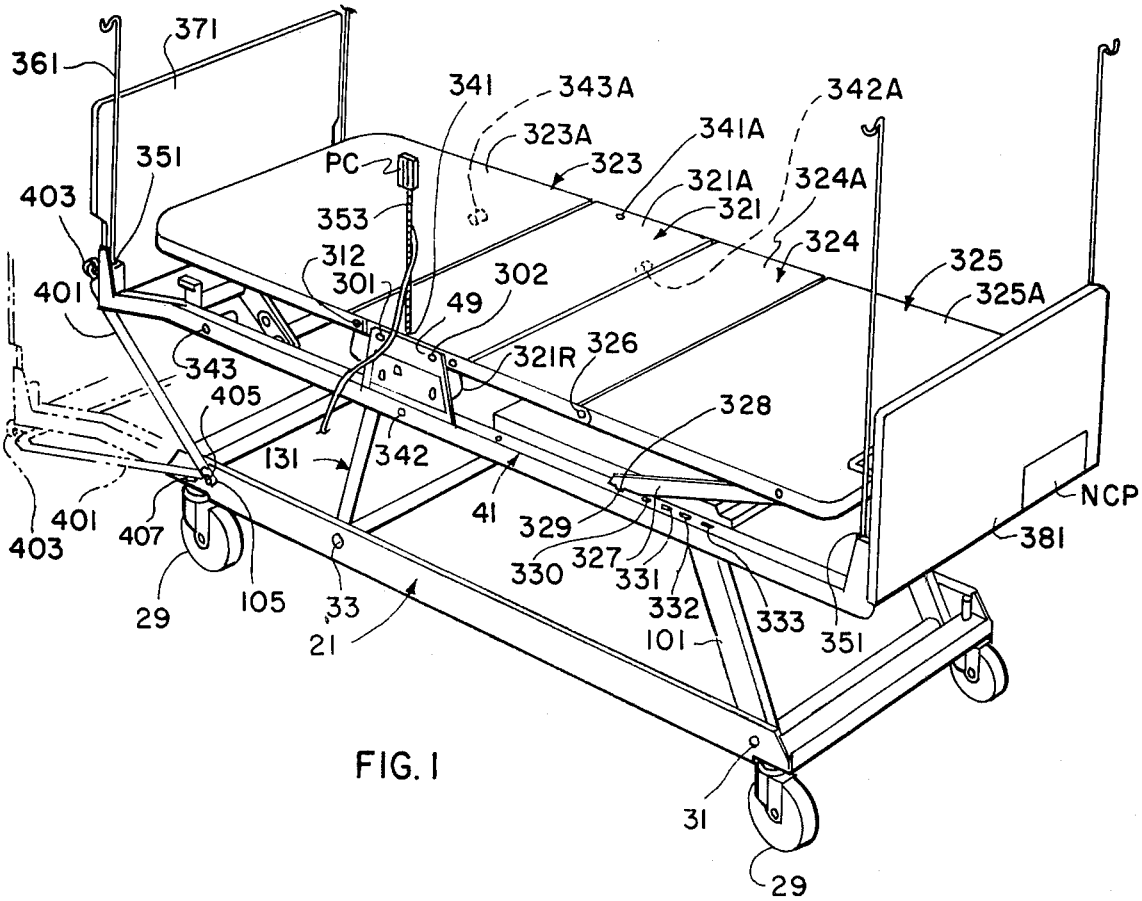
FIG. 1 is a perspective view of a bed according to the invention.

Referring now in detail to the Figures of the drawings, a hospital bed 11 is provided, having a torque-compensated parallelogram lifting arm arrangement, including parallelogram lifting assemblies 101, 131, pivotally mounted on pivot shafts 31 and 33 on a vertically stationary base 21. The bed has a subframe 41 forming an upper segment of and being vertically adjustable by the lifting arm assemblies 101, 131. Subframe 41 remains horizontal at all adjustment heights.

Headboard 371 and footboard 381 are suitably removably mounted on the head and foot ends of the subframe 41. Patient control pendant PC may be removably mounted in a flexible wire pendant support which is removably insertable in seat section vertical sockets 341 and 341A, or in vertical sockets 351 formed at the four corners of the subframe and which enable always vertical mounting of IV rods 361, fracture frames, etc., independent of bed adjustment height or articulation of the mattress to any selected treatment positions.

A cantilevered U-shaped wall bumper 401 is pivotally mounted at 405 at the rear end of rectangular base 21, and is frictionally self-retained at a given selected pivot position, by a suitably frictionally tight pivot connection with the base 21. Bumper wall-engaging rollers 403 extend rearwardly from the bumper outer cross bar section. The bumper is engaged by the subframe 41 as the subframe 41 is pivotally rearwardly and downwardly lowered, to effect concomitant pivotal lowering of the bumper unit 401 and effective horizontal extension of the effective horizontal wall-to-bed spacing as the bed is lowered. The wall bumper 401 is otherwise simply manually adjustably movable about its pivot 405. A suitable stop, formed as by a protruding detent element 407 on the side or sides of the base 21, or by other suitable stop such as at the pivot connection 405, serves to locate the lowermost pivot position of the bumper 401 in a below-horizontal position through engagement therewith at this lowermost desired position of the bumper 401, which over-center positioning serves to self-hold the bumper in the down position once it is placed there, until otherwise moved by the nurse or other operator.

The bed may be conventionally rolled around as by casters 29 on base 21.

Safety siderail sockets 342, 342A, 343, 343A are provided on both sides of the mattress support subframe 41.

A nurse control panel NCP is located at the foot end of the bed 11, with a suitable pivoted cover thereover.

The mattress support subframe 41 provides the support structure for and carriers the seat section 321, and the other articulated head or back, thigh and leg or foot sections 323, 324, 325 forming articulated mattress-supporting surface 321A, 323A, 324A, 325A, and a means to mount the motor and gear reduction units 305, 305A, 305B, the nurse control panel NCP, the electrical control circuitry, and the removable wooden head and foot panels. It also provides sockets 351 in the four corners for IV rods and mounting fracture frames and traction equipment. The subframe 41 also provides the attachment points for the parallelogram lifting mechanism.

LIFTING MECHAMISM

The raising and lowering of the bed 11 is accomplished by the opening and closing of a powered parallelogram-type mechanism. A portion of the stationary base assembly 21 forms the lower horizontal side of the parallelogram, and a portion of the vertically adjustable mattress support subframe 41 forms the upper horizontal side of the parallelogram that raises and lowers the mattress support frame, which in the illustrative embodiment comprises mattress support subframe 41 and articulated mattress support sections 321, 323, 324, 325. The foot end lifting arm assembly 101 and the head end lifting arm assembly 131 form the other two sides of the parallelogram.

The base assembly 21 includes a rectangular frame formed by left and right side members 23, 23A, tied together by foot and head end cross members 25, 27 welded or otherwise secured thereto. Tubular sockets are provided on the four corners of the base 21, in which are secured suitable casters 29 of conventional or other desired construction.

Mattress support subframe assembly 41 is also generally rectangular, and includes left and right siderails 43, 43A, foot and head end panel supports 45, 47 and left and right seat support brackets 49, 49A. The seat support brackets 49, 49A are tied together for rigidity by a seat cross tube 53 welded or otherwise suitably secured thereto. The siderails 43, 43A are tied together at each end by foot and head end cross members 55, 57 and two angle brackets 59, 59A, and two brackets 61 and 61A, foot panel support 45, and head panel support 47, all welded or otherwise suitably secured together.

The foot end cross member 55 is provided with suitable horizontal cross axis pivot supports 62 for pivotal attachment of head, foot, and elevate motor and gear box units 305, 305A and 305B. Struts 63, 63A are secured, as by welding, to foot end cross member 55 and foot end panel support 45, and provide a suitable means for supporting the motor enclosure 65, also providing a support surface for the articulated leg section 325 of the mattress support assembly when the pivoted leg section brace 327 is fully down and not engaged in an adjustment slot or hole 329–333, etc. in the subframe 41. The foot end cross member 55 also has fixedly secured thereto, as by welding, left and right hanger brackets 67, 67A. The hanger brackets 67, 67A have pivot support holes in which are secured, as by a set screw, a pivot shaft 69. The head end cross member 66 has welded thereto left and right hanger brackets 71, 71A, which have pivot support holes in which are secured, as by a set screw, a pivot shaft 73.

Pivot support shafts 31, 33 on the base assembly 21, and pivot support shafts 69, 73 on the subframe assembly 41, provide the fixed pivot points of the parallelogram.

The foot end lifting arm assembly 101 includes left and right lifting arms 103, 103A fixedly tied together by a pivot tube 105 and a torque tube 107. The torque arms 109 and 109A are welded to the torque tube 107, and are provided with pivot holes through which extend a through pivot shaft or stub shafts or pins 111. A pivot bracket 113 is welded to the torque tube 107 and provides a pivotal connection with the foot end of a connecting rod 169, later to be described. The lifting arms 103, 103A are provided with pivot holes in which bushings are disposed, for pivot shaft 69. A bushing is also inserted in each end of the pivot tube 105, which bushings ride on base pivot shaft or axle 31.

The head end lifting arm assembly 131 includes upwardly and inwardly inclined left and right lifting arms 133, 133A fixedly tied together by a pivot tube 135, torque arms 137, 137A, spacer bar 139, and pivot tube 141. The generally triangularly shaped lifting arm assembly formed by inclined arms 133, 133A aids substantially in lateral rigidifying of the parallelogram lifting arm assembly and the height adjustable portions of the bed, particularly at raised positions. Suitable bushings are inserted in each end of the pivot tubes 135 and 141 for receiving base head end pivot shaft or axle 33 and subframe head end stub pivot pins 73. The torque arms 137 and 137A are provided with pivot holes for pivotal securement through pivot pin 143 to the head end of drag link 145.

The dimensional relationship of pivot points formed by the elements 105 (31), 107 (69), and 111 on foot end lifting arm assembly 101 is identical to pivot points formed by the elements 135 (33), 141 (73), and 143 on head end lifting arm assembly 131. The longitudinal distance between pivot support shafts 31 and 33 on the base assembly 21 is equal to the longitudinal distance between pivot support shafts or pins 69 and 73 on the subframe assembly 41.

Drag link 145 is preferably formed of heavy gauge sheet metal, and formed up in a hat or flanged-inverted-U cross-section along its major extent, the strengthening lateral flanges being omitted at the opposite pivot connection ends of the drag link for ease of pivotal connection and freedom of pivotal motion. Each end of the drag link 145 has a fixed pivot tube, for pivotal connection to corresponding pivot pins 143, 111. Gussets 151 and 151A are welded to the drag link 145 and provide pivot holes in which are mounted a pivot pin 157 for a bell crank 159, later to be described. The distance between pivot pins 143 and 111 is equal to the distance between pivot shafts 31 and 33 on the base assembly 21 and the distance between pins 69 and 73 on the subframe assembly 41.

Figure 24:
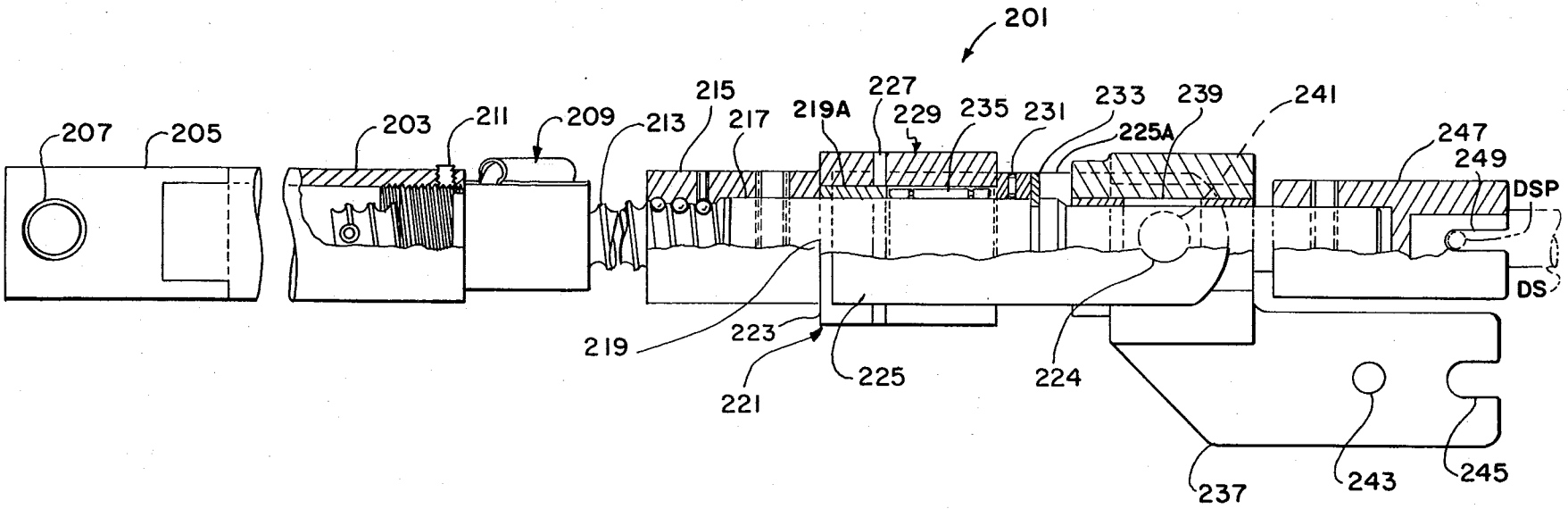
FIG. 24 is a further side elevation, partially in section, of the elevate drive screw arrangement.

An elevate drive screw assembly is generally indicated at 201 (see particularly FIG. 24). The drive tube 203 is a round steel tube with a flat bar 205 welded in one end and having a pivot hole with a suitable, e.g. bronze, bushing 207. The other end of drive tube 203 is threaded for attachment of ball nut 209, and secured with set screw 211. Ball nut 209 is threaded on a ball screw 213, both of which may be of standard conventional construction. Coupling 215 is threaded and pinned on ball screw 213. Drive shaft 217 is engaged in coupling 215 and pinned. Drive shaft 217 is free to rotate in bushing 219A of bearing support bracket 211. Bracket 211 is formed of a steel bar section 223 with a hole 219 having a bronze bushing 219A therein. Straps 225 and 225A are welded to bar section 223 and are provided with aligned pivot holes which receive pivot pins 224 carried by the pivot supports 62 on foot end cross member 55.

Brake washer 227, clutch assembly 229, needle thrust bearing 231, and bearing support bracket 221 are assembled on drive shaft 217 between coupling 215 and retaining ring 233. Clutch assembly 229 includes a tubular steel clutch housing with a one-way clutch 235, which may be of standard construction, press-fit therein. A motor mounting bracket 237, preferably plastic or of other insulating material is also installed on drive shaft 217, which is free to rotate in it. Motor mounting bracket 237 is a plastic injection-molded part provided with drive shaft hole 239, pivot hole 241 and motor mounting holes 243 and 245. Motor drive coupling 247 is a plastic injection-molded part that fits on drive shaft 217 and is pinned in place. The other end of coupling 247 engages on the elevate motor gear box unit output drive shaft DS. A cross pin DSP in the drive shaft DS removably engages in driving relation in slot 249 of coupling 246.

Commercial ball screw and nut assemblies are available which are about 90% efficient. The elevate drive screw assembly 201 desirably employs such a high efficiency ball screw and nut 213, 209. This drive screw assembly 201 is always in tension between pivot points 224 of the bearing support bracket 221 and pivot point formed by bushing 207 of the drive tube 203, as the bed is raised. Clockwise rotation of the motor drive coupling 247 and the right-hand thread of the ball screw 213 causes the drive tube 203 to retract and the bed to raise through raising of subframe 41. Counterclockwise rotation of coupling 247 effects lowering of subframe 41. Unless a braking force is applied to the ball screw 213, the bed will coast back down due to the high efficiency of the ball screw. A worm gear drive motor could be used and would act as a back drive resistive brake, but this is undesirable for manually cranking in case of power failure. Since a hand crank will not work on the output shaft of a worm gear motor, it would have to be manually cranked, in emergency or other necessary manual cranking operation, through the rotor or the electric motor, requiring hundreds of turns to raise or lower the bed.

A separate brake on the drive shaft makes it possible to employ straight pinion gear reduction in the elevate motor and gear box units, and to operate the bed either manually or electrically, and also allows the removal of the motor and gear reduction unit 305B any bed height without undesirable backdriven lowering. The one-way clutch 235 allows the drive shaft 217 to rotate freely in the clockwise direction. The thrust load is applied to the needle bearing 231 and rotates with high efficiency. The clutch assembly 229 remains stationary since the friction between it and the brake washer 227 is much greater than that of the needle bearing 231. When the bed is lowered, the clutch 235 locks on the drive shaft 217, causing the clutch assembly 229 to rotate on the surface of the brake washer 227 and adding the necessary friction to prevent the bed from self-backdriving or coasting down. The brake washer 227 may add sufficient friction such that the torque can be approximately the same for raising and lowering under a given load, thus preventing the ball screw 213 from backdriving down. The amount of frictional resistance provided by the brake is directly proportional to the load.

If an acme-type screw is employed in lieu of the preferred relatively high efficiency ball screw, which may be done, but is much less desirable, (and is in fact preferably employed for the mattress support section articulation adjustment screws later to be described) such will not require a brake in this application, due to its low efficiency caused by the friction of the threads. The disadvantage of the acme screw is that the total torque required is equal to the load torque plus the high frictional torque. The advantage of the ball screw is that the total torque is equal to the load torque plus a very low frictional torque. The brake only adds friction in the down direction, when it is needed.

The foot end lifting arm 101 is assembled to the base assembly 21 by means of a shaft 31, the shaft being secured as by set screws in the collars in the base side members 23, 23A.

The head end lifting arm 131 is assembled to the base assembly 21 by means of a shaft 33, the shaft being secured as by set screws in collars in the base side members 23, 23A.

The foot end lifting arm 101 is assembled to the mattress support subframe assembly 41 by means of pivot pins 73 pivotally connected to the lifting arms 103, 103A. Pivot pins 73 are secured to hanger brackets 67, 67A, as with screws.

The head end lifting arm assembly 131 is pivotally assembled to the subframe assembly 41 by means of pivot pins 73. Pivot pins 73 are secured to hanger brackets 71 and 71A, as with screws.

Drag link 145 is pivotally connected to the foot end lifting arm assembly 101 (103, 103A) by means of pivot pin 111 connecting with torque arms 109 and 109A, and pivot tube 147 in the drag link 145. Pivot pin 111 is secured to torque arms 109 and 109A, as by means of set screws. The drag link 145 is assembled to the head end lifting arm 131 by means of pivot pin 143 pivotally connecting with torque arms 137, 137A and the pivot tube 149 in the drag link 145. Pivot pin 143 is suitably held in place as by retaining rings.

The elevate drive screw assembly 201 is pivotally supported by the mattress support sub-frame assembly 41 by means of horizontally aligned spaced pivot pins 224 on the pivot supports 62, pivotally engaging in the opposite aligned pivot holes in the bearing support 221 and also in the pivot hole 241 of motor and gear box unit mounting bracket 237. The pivot supports 62 may be suitably secured, as by bolting, to foot end cross member 55.

The elevate drive tube 203 is pivotally secured to the bell crank 159 by means of a pivot pin 161 in pivot holes of the bell crank and pivot hole of elevate drive tube 203. Pivot pin 161 is trapped between gussets 151 and 151A of the drag link 145. Bell crank 159 is pivotally connected to the drag link 145 by means of pivot pin 157 in gussets 151, 151A and extending pivotally through a pivot hole in bell crank 125. Pivot pin 157 may be suitably held in place as by retaining rings. Rod eye 165 is assembled to bell crank 159 by means of pivot pin 167 inserted in pivot holes in bell crank 159 and pivot holes in rod eye 165. Pivot pin 167 may be suitably secured as by retaining rings.

Connecting rod 169 is adjustably threaded into rod eye 165 by means of a left hand thread and threaded into rod eye 171 by means of a right hand thread. Rod eye 171 is pivotally connected to pivot bracket 113 by means of a hitch pin 173 inserted in pivot bracket 113 and a pivot hole in rod eye 171. Hitch pin 173 is secured in pivot bracket 113, as by means of a hitch pin clip.

The raising and lowering of the bed is controlled by two switches in the nurse control panel NCP. The "Hi-Lo" switch S6 controls the bed height from a low height, (e.g. with the mattress supporting surface 321, 323, 324, 325 approximately 17 inches from the floor), to an intermediate "Nurse Height", (e.g. with the mattress supporting surface approximately 26 inches from the floor). The "Hi-Lo" switch may desirably be a toggle action three-position switch, with a center off position and opposite pole connections in opposite directions of toggled movement, thus allowing a "Walk-Away" feature of having the bed raise automatically to "Nurse Height" and stop by means of an intermediate limit switch, EI/NL actuated by a cam lobe on a conventional ganged lobe rotatable cam (not shown) in the gear reduction box of the elevate motor and gear reduction unit 305B. The "Hi-Lo" switch also allows the bed to be automatically lowered and stop in the low position by means of a similarly cam actuated down limit switch EDL in the elevate motor and gear reduction unit 305B. The center "OFF" position on the "Hi-Lo" switch allows the bed to be selectively adjusted to and stopped at any intermediate height. With the bed at "Nurse Height" and the "Hi-Lo" switch in the "Hi" position, the bed height may be further raised and adjusted to a desired maximum height (e.g. 34 inch mattress supporting surface to floor) by means of the momentary contact push button self-opening "Stretcher" or "Max" switch S5 in the Nurse Control Panel NCP. The similarly motor revolutions responsive cam actuated up limit switch EUL in the elevate motor EM stops the bed at the desired maximum (e.g. 34 inches) height. The elevation "Max" or "stretcher" switch S5 may be suitably used to adjust the bed height to the height of a stretcher.

To lower the bed from stretcher height, the "Lo" position on the "Hi-Lo" switch is used. In a suitable embodiment constructed according to the invention, the "Hi-Lo" switch S6 controls the first 9 inches height range and the "Max" switch S5 controls an additional 8 inches height range. The total height range is 17 inches. The total height range can also be adjusted by means of cranking through the output shaft of the elevate motor with a manual crank CR, which acts on a rearwardly protruding end of elevate motor and gear reduction unit output drive shaft DS.

During raising and lowering of the bed by the elevate motor EM, the foot end lifting arm 101 rotates on shaft 31 on the base 21 and on pivot pin 69 on the sub-frame 41. The head end lifting arm 131 rotates on shaft 33 on the base 21 and on pivot pins 73 on the sub-frame 41. Shaft 31 and 33 and pivot pins 69 and 73 form the four pivot points of the lifting arm parallelogram. In the low position of the illustrated embodiment (e.g. 17 inches), the lifting arms 101 and 131 are about 1° below horizontal in relation to shafts 31 and 33. In the maximum height position (e.g. 34 inches) the lifting arms 101 and 131 are about 65° above horizontal, (i.e.: pivot pins 69, 73 are 65° above horizontal in relation to shafts 31 and 33). Drag link 145 may rotate on pivot pin 111 of lifting arm 101 and on pivot pin 143 of lifting arm 131 through an angle of approximately 66°, (i.e.: pivot pin 111 moves 33° from one side of vertical to 33° on the other side of vertical in relation to pivot pin 73. In a typical practical illustrative embodiment, the drag link 145 may move a horizontal distance of approximately 5 1/16 inches through the 66° angular movement.

Pivot pins 69, 73, 111, and 143 form the four pivot points of another parallelogram.

Figure 6:
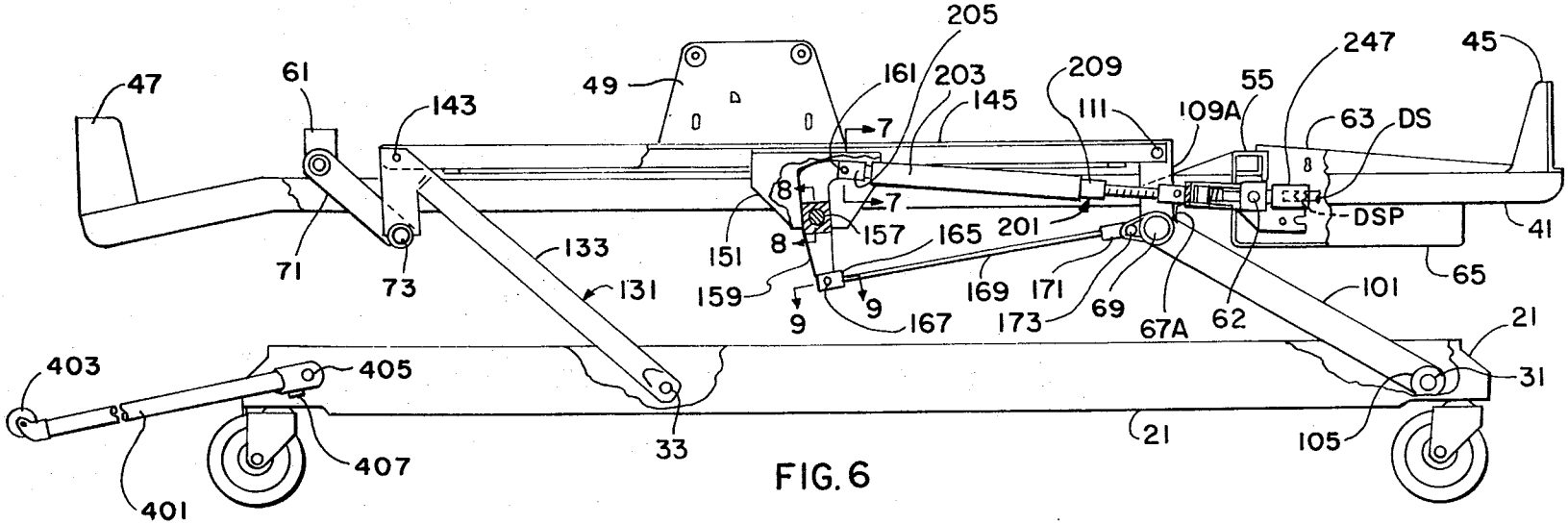
FIG. 6 is a side elevation partially cut away and with parts omitted illustrating the torque-compensated height adjustment arrangement.
Figure 6A:
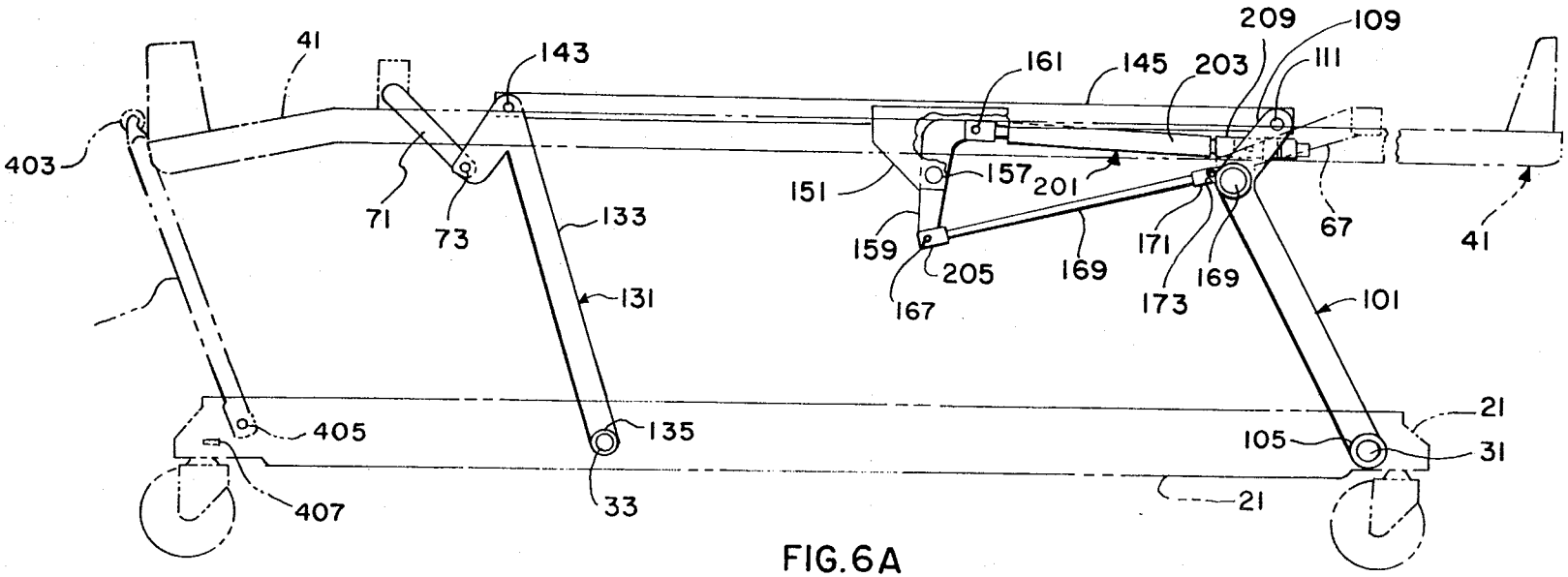
FIGS. 6A and 6B are schematic side elevations with some parts in phantom for clarity, illustrating various height adjustment positions of the bed, FIG. 6B being the bottom position.
Figure 6B:
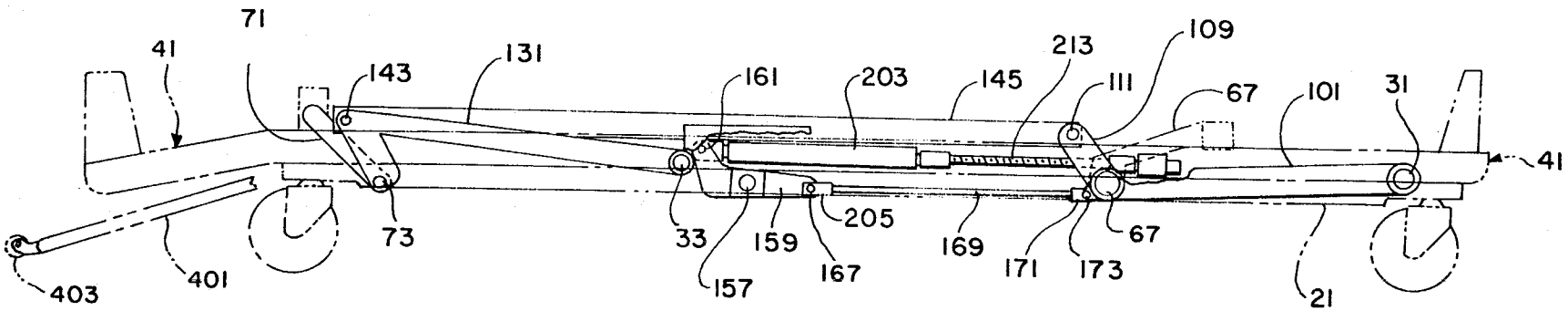
Figure 11:
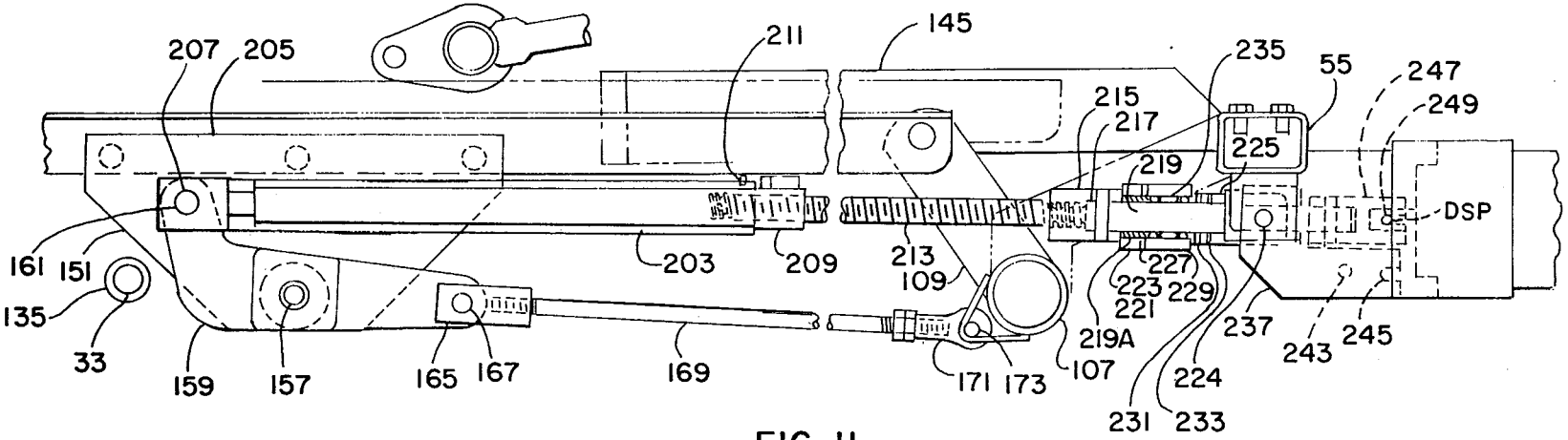
FIG. 11 is a fragmentary view partially cut away of a portion of the height adjustment arrangement.
Figure 12:
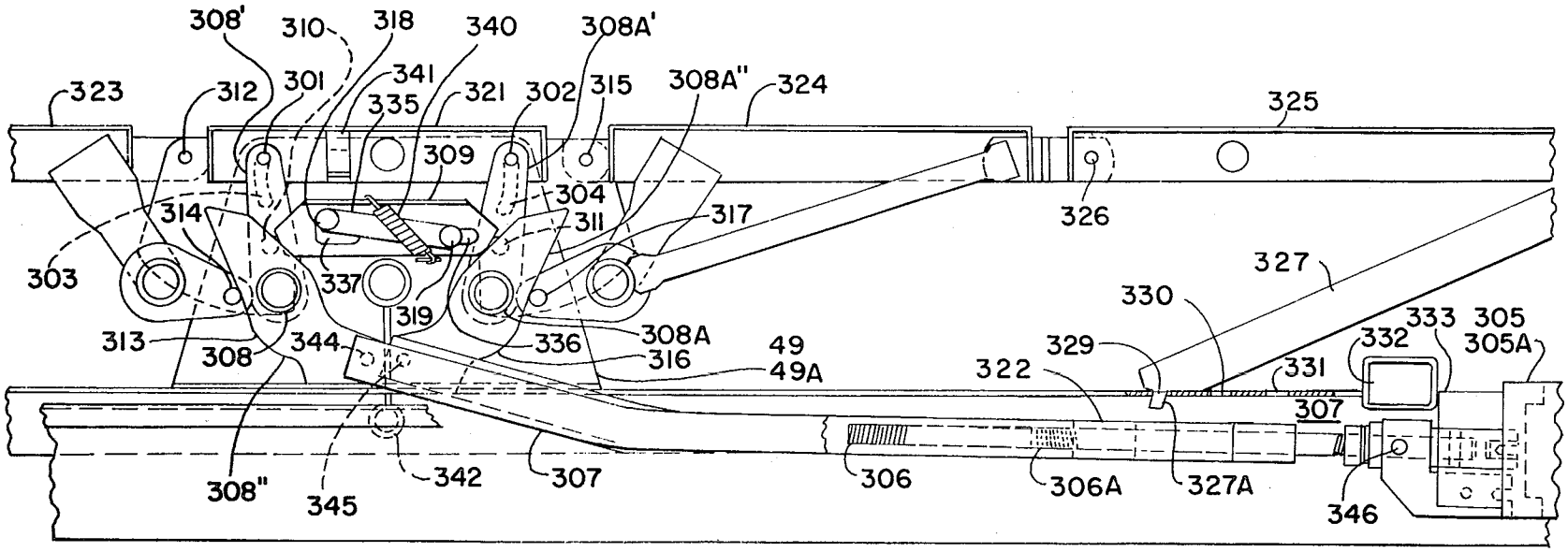
FIG. 12 is a fragmentary view of a portion of the mattress support surface articulation arrangement.

When the bed is in the lowest height (17 inches) position as shown in FIG. 6B, the position of the bell crank 159 and the connecting rod 169 is such that the pivot pins 157, 167, and 173 are in a substantially straight line relationship, and the elevate drive tube 203 is fully extended.

When the up circuit to the elevate motor is completed with either the "Hi-Lo" or "Max" switches, S6 or S5, the elevate motor EM rotates in a clockwise direction, causing the right hand lead ball screw 213 to rotate in the ball nut 209 and retract the elevate drive tube 203. As the elevate drive tube 203 retracts and pulls on pivot pin 161, it causes bell crank 159 to pivot or rotate on pivot pin 157. As bell crank 159 rotates, pivot pin 167 is traveling in a downward arc, and pulls on connecting rod 169, causing the distance between pivot pin 157 and hitch pivot pin 173 to become shorter. This motion causes a pulling force on pivot pin 157, which in turn pulls on the drag link 145. The drag link 145 exerts a horizontal force on the foot end torque arms 109 and 109A through pivot pin 111, and also on the head end torque arms 137 and 137A through pivot pin 143. The torsional force exerted on the foot end torque arms 109 and 109A is transmitted into torque tube 107 and lifting arms 103 and 103A, on through to pivot tube 105, causing foot end lifting arm 101 to rotate on shaft 31 and pivot pins 69. The torsional force exerted on the head end torque arms 137 and 137A is transmitted into lifting arms 133 and 133A, causing head and lifting arm 131 to rotate on shaft 33 and pivot pins 73. As foot end lifting arm 101 and head end lifting arm 131 rotate above horizontal, sub-frame assembly 41 attached to pivot pin 73, is raised.

The lowering operation is the reverse of the lifting position described above.

The main shortcoming of using conventional parallelogram lifting mechanisms is the large mechanical disadvantage in raising the bed from the low position. In one operational example according to the illustrative embodiment as described above, when the lifting arm is horizontal, the ratio of the lifting arm moment to the direct acting torque arm moment is about 4.6 to 1. When the bed is in the fully raised position, the ratio of the lifting arm moment to the torque arm moment is about 1.9 to 1. Thus, the mechanical disadvantage is changing through a range of 4.6 to 1 down to 1.9 to 1 as the bed is raised. If the elevate drive tube 203 were pivotally attached directly to the drag link 145, the mechanical disadvantage would be 4.6 to 1 in the low position and would drop to 1.9 to 1 as the bed is raised to the high position.

Another shortcoming in using parallelogram lifting mechanisms is the deflection that occurs in the four sides of the parallelogram when the bed is heavily loaded in the low position. When the lifting arms are near horizontal, most of the load is carried in bending. When the lifting arms are near vertical, most of the load is in compression. Due to the accumulated deflection that occurs in the mechanism in the low position, the true parallelogram has been slightly deformed, adding additional binding and inefficiency to the mechanism. This causes the theoretical disadvantage of 4.6 to 1 to increase, depending on the rigidity of the member.

The torque-compensated lifting arm arrangement according to the foregoing described aspect of the invention is accordingly an important feature and contribution to the art, and offers much advantage. The bell crank 159 lowers the mechanical disadvantage through the entire travel and materially counteracts the natural inefficiencies of the parallelogram in the extreme low and adjacent positions. When the bed is in the lowest position pivot pins 157, 167, and 173 are in a substantially straight line relationship, as previously noted, and the effective moment arm of bell crank 159 between pivot pins 157 and 167 is almost zero. As the elevate drive tube 203 retracts and pulls on pivot pin 161, the resultant pull of pivot pin 167 on rod eye 165 is quite large, being in the illustrative example almost infinite, since the effective moment arm between pivot pins 157 and 161 is very much greater than the minute moment arm between pivot pins 157 and 167 on bell crank 159. At this position the high mechanical advantage of the bell crank materially counteracts the high mechanical disadvantage of the lowered lifting arms and enables quite easy raising even from the lowermost parallelogram position as shown in FIG. 6B.

As the bed is raised, the mechanical advantage of the bell crank 159 decreases, while the mechanical disadvantage of the lifting arms 101, 131 decreases, thus acting to provide a quite satisfactory torque compensation and ease and rate of lifting along the extent of height adjustment of the sub-frame assembly 41.

The addition of the bell crank 159 increases the length of the screw 213 travel, as compared to a direct drive to the parallelogram. In the particular illustrative embodiment, the length of the screw travel is about double the travel that would be required if the elevate drive tube 203 were connected directly to the drag link 145; however, the horsepower required to lift the bed is materially and desirably reduced, and particularly at the critical normally difficult lower position zone.

It will be appreciated that while the horsepower requirements may also be reduced, to a degree, by decreasing the lead of the screw or by reducing the speed of the output shaft in the gear train of the motor, this can only be accomplished within practical limits, and the rate of height adjustment and power requirement will vary over a wide range between the lower and upper limits of height adjustment if such are the sole methods employed.

As an alternative, but materially less desirable, modification, the mechanical disadvantage of the mechanism can also be reduced by a factor of two by substituting a cable and pulley system (not shown) in place of the bell crank. In such a modification, a pulley (not shown) may be rotatably mounted on drag link 145, as through a cross-pin. A cable may be connected at one end to a torque tube connected to two of the lifting arms 101, thereupon wrap around the pulley one-half turn, and be attached at its opposite end to elevate drive tube 203. In such a modification, for each inch of travel as the elevate drive tube 203 retracts, the drag link 145 moves ½ inch. The tension load on the elevate drive screw assembly 201 will have been reduced by a factor of two, as compared to a direct pivotal connection without bell crank or pulley, hence the maximum required horsepower at all heights is also reduced by one-half. The elevate drive screw assembly travel is double the drag link 139 travel.

Figure 22:
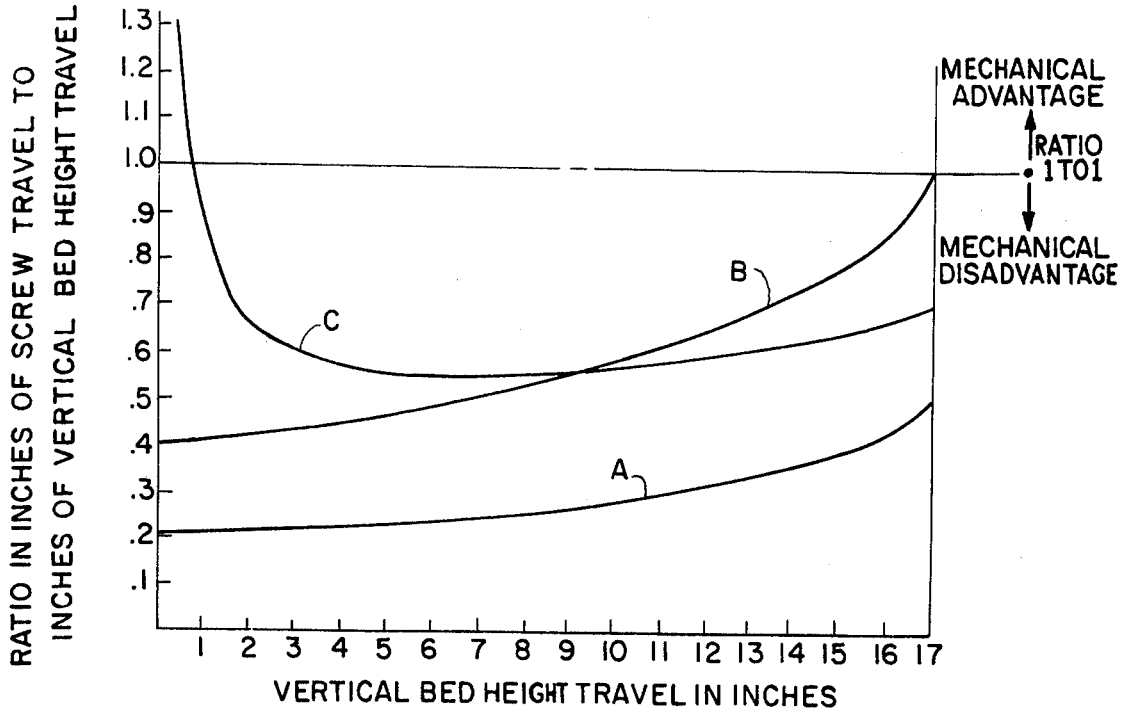
FIG. 22 is a graph generally indicating the relative mechanical advantages of various lifting arrangements.
Figure 2:
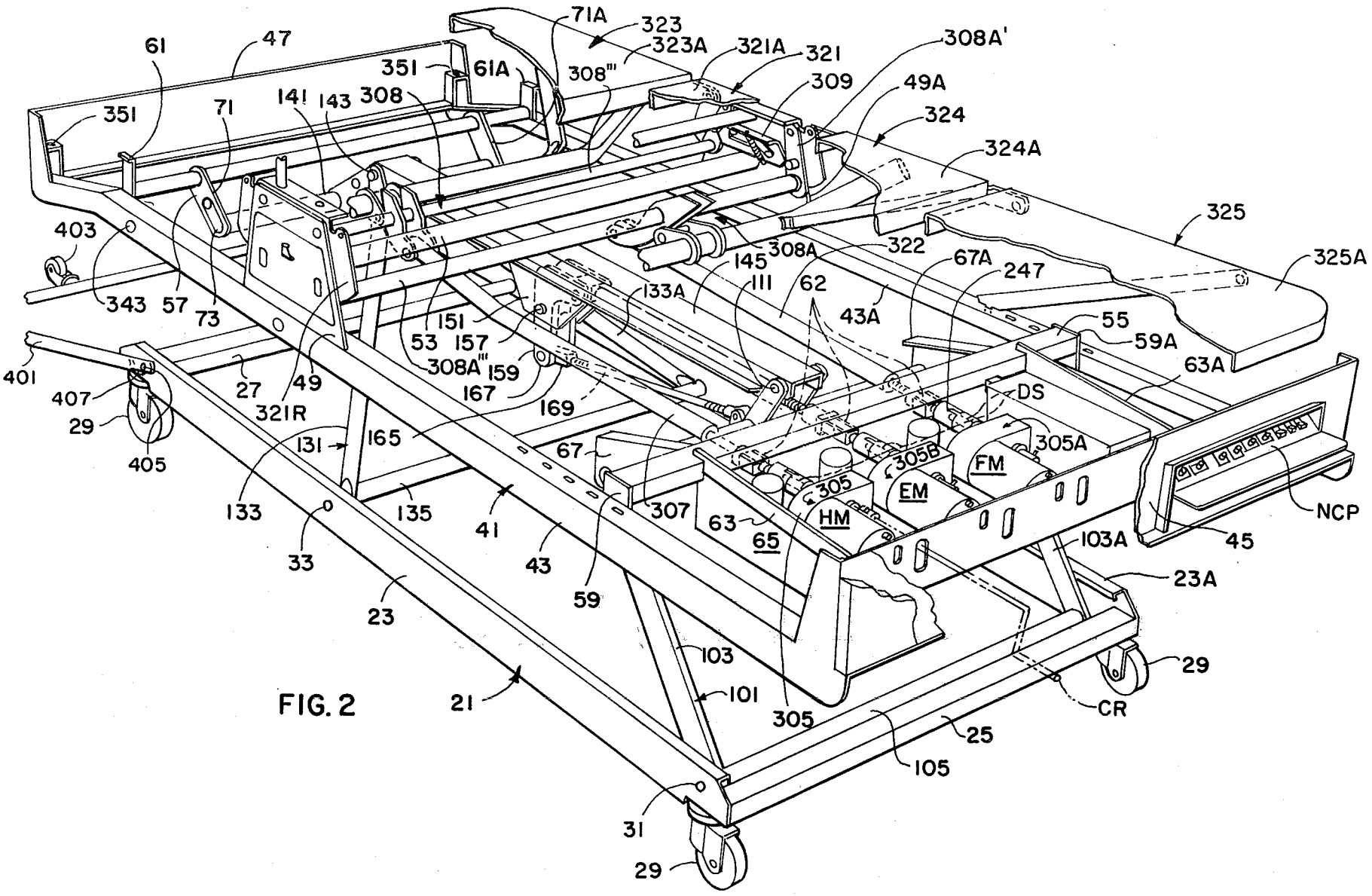
FIG. 2 is a perspective view of the bed of FIG. 1 with the headboard and footboards removed and with portions cut away for clarity.
Figures 2A, 2B:
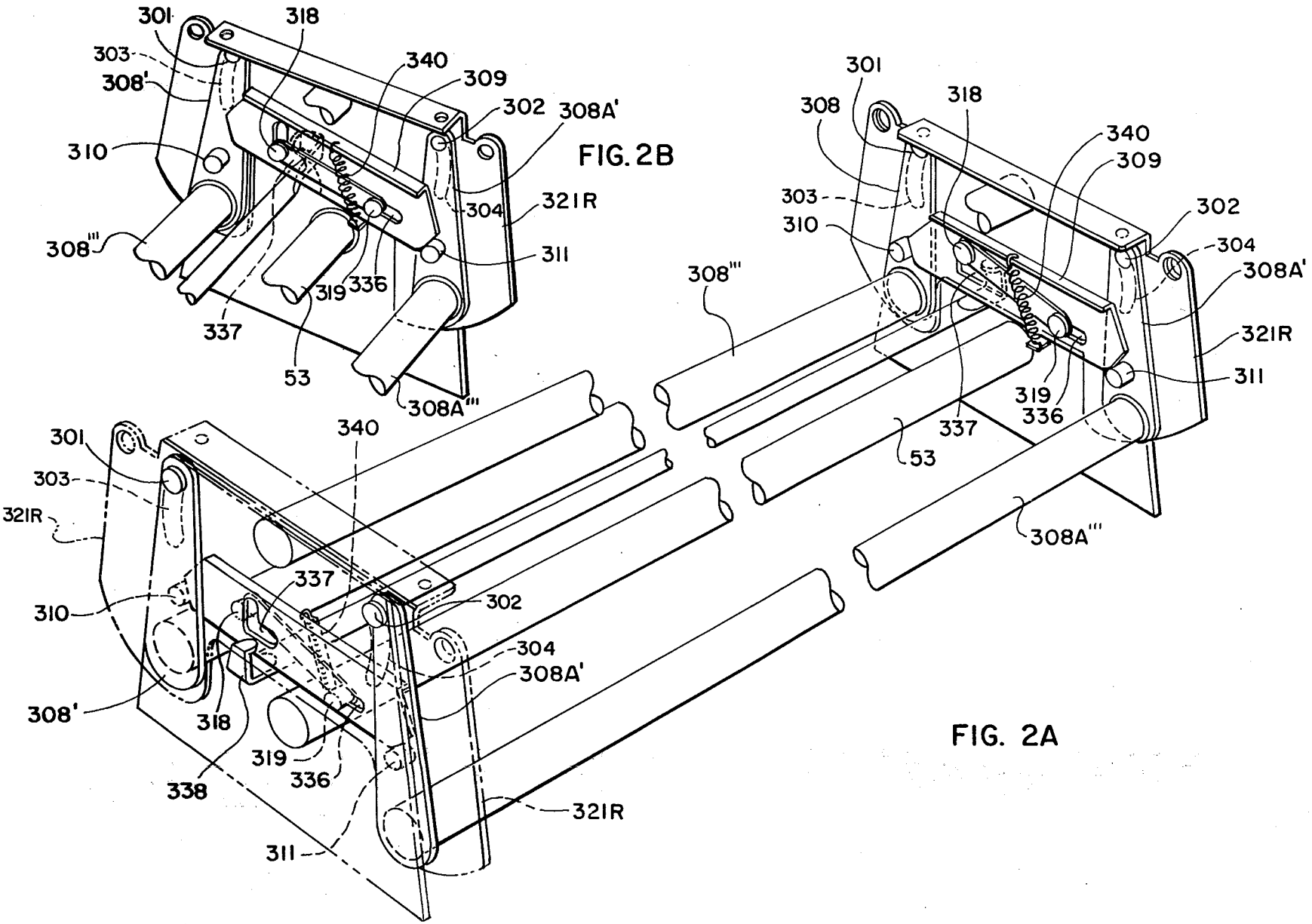
FIG. 2A is a fragmentary enlarged view of the seat section support arrangement.
FIG. 2B is a view of one end of the seat section support arrangement, showing the trip rod and selector bar in active seat-pivot-effecting defeat position.
Figure 2C:
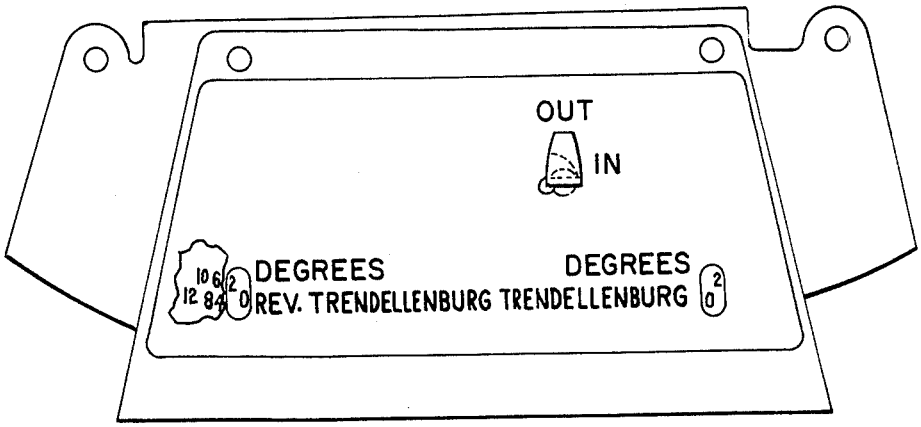
FIG. 2C is a side elevation view, partially cut away, schematically illustrating the visible tilt angle indicating arrangement for Trendelenburg and Reverse Trendelenburg positions.
Figure 10:
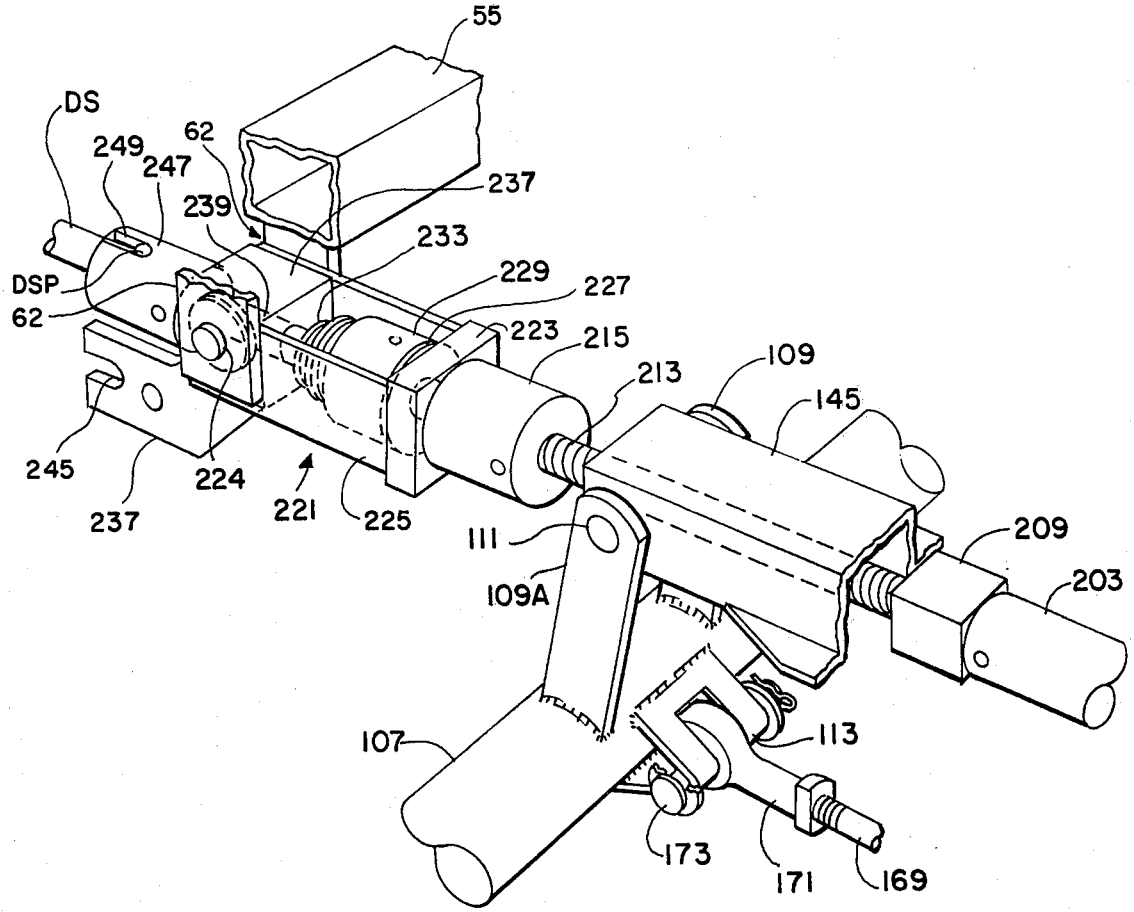
FIG. 10 is a fragmentary perspective view of a portion of the elevate drive assembly.
Figure 3:
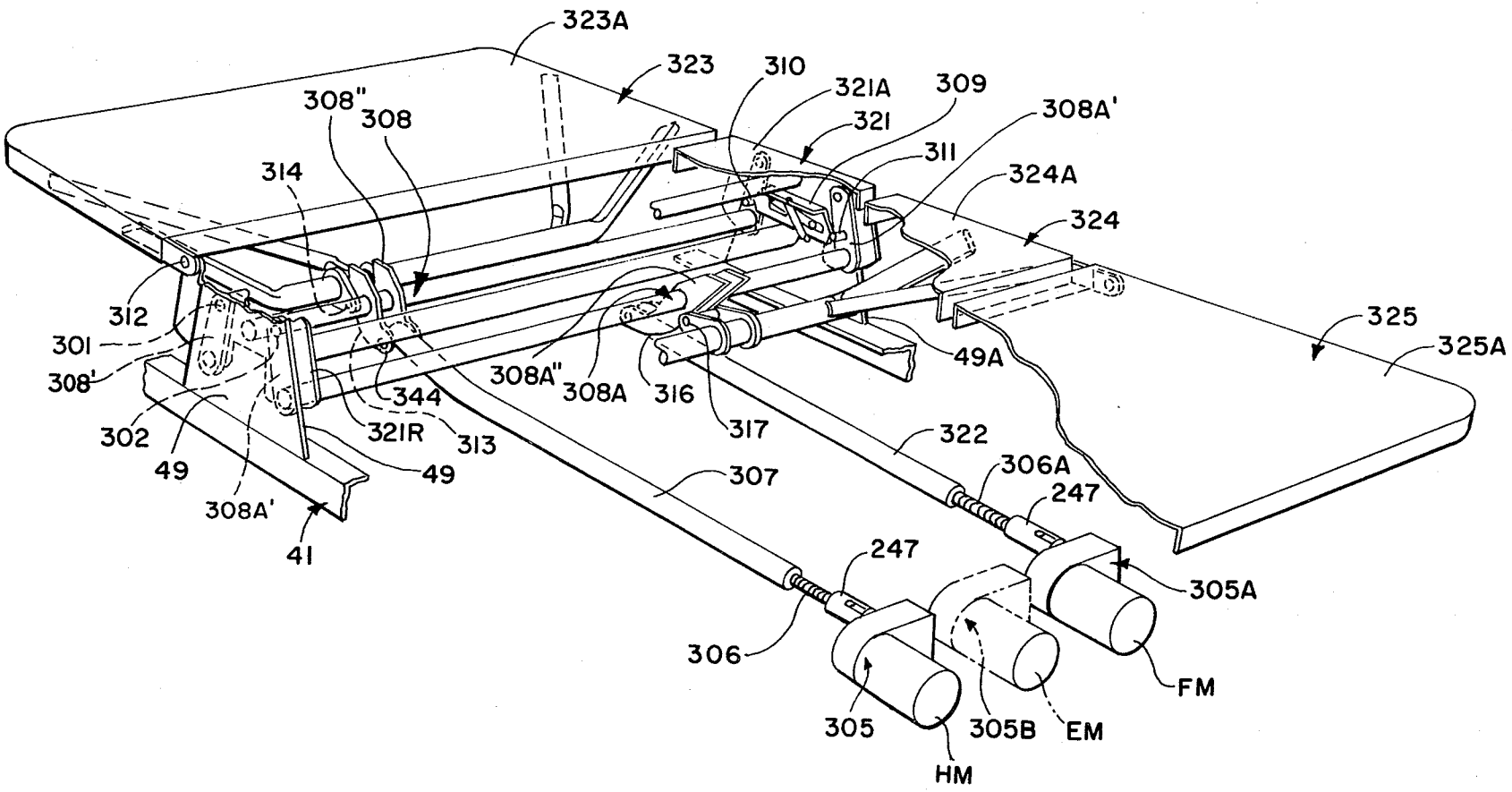
FIG. 3 is a fragmentary perspective view illustrating the mattress support section articulation arrangement.
Figure 4:
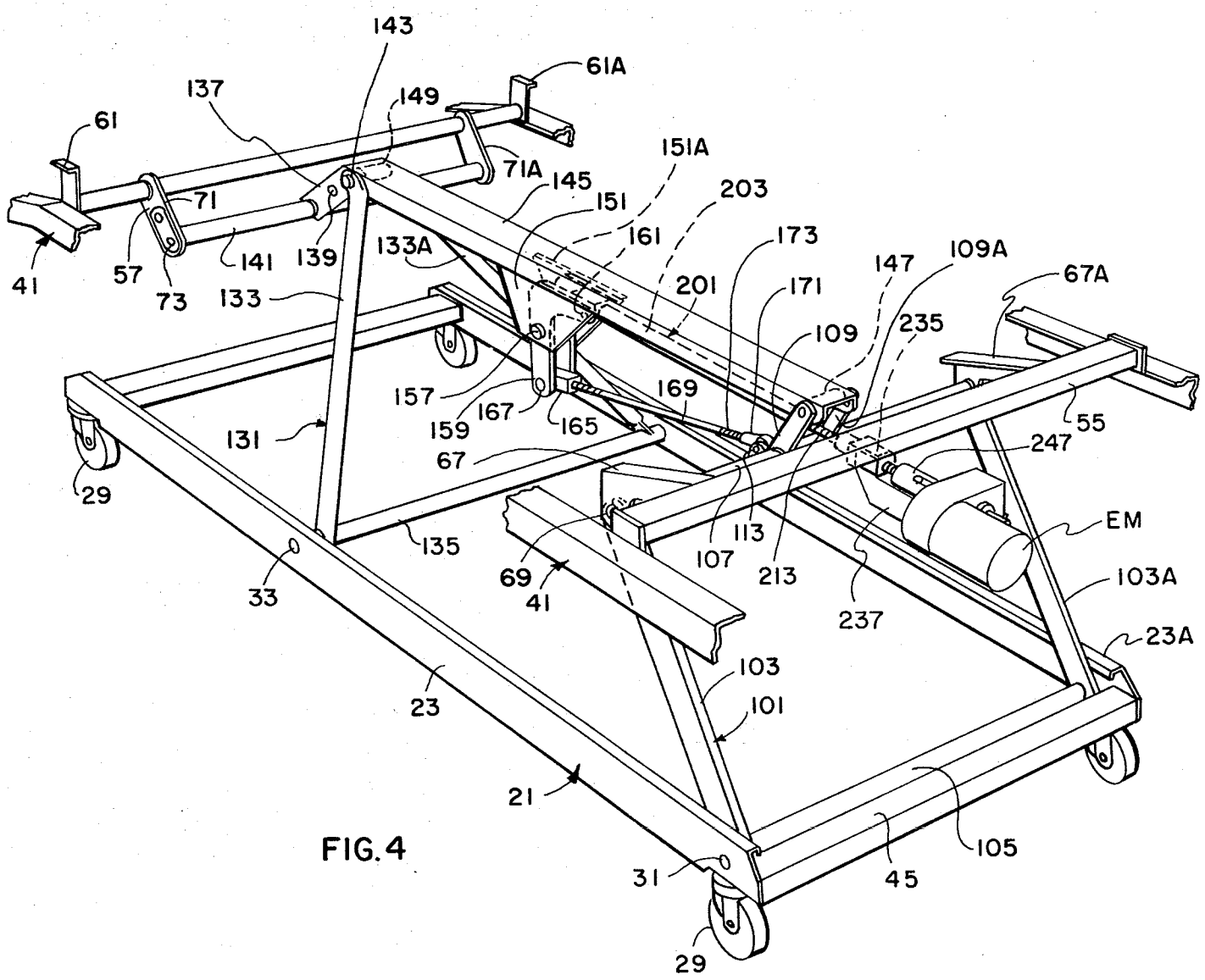
FIG. 4 is a fragmentary perspective view illustrating the height adjustment torque-compensated parallelogram arrangement.
Figure 5:
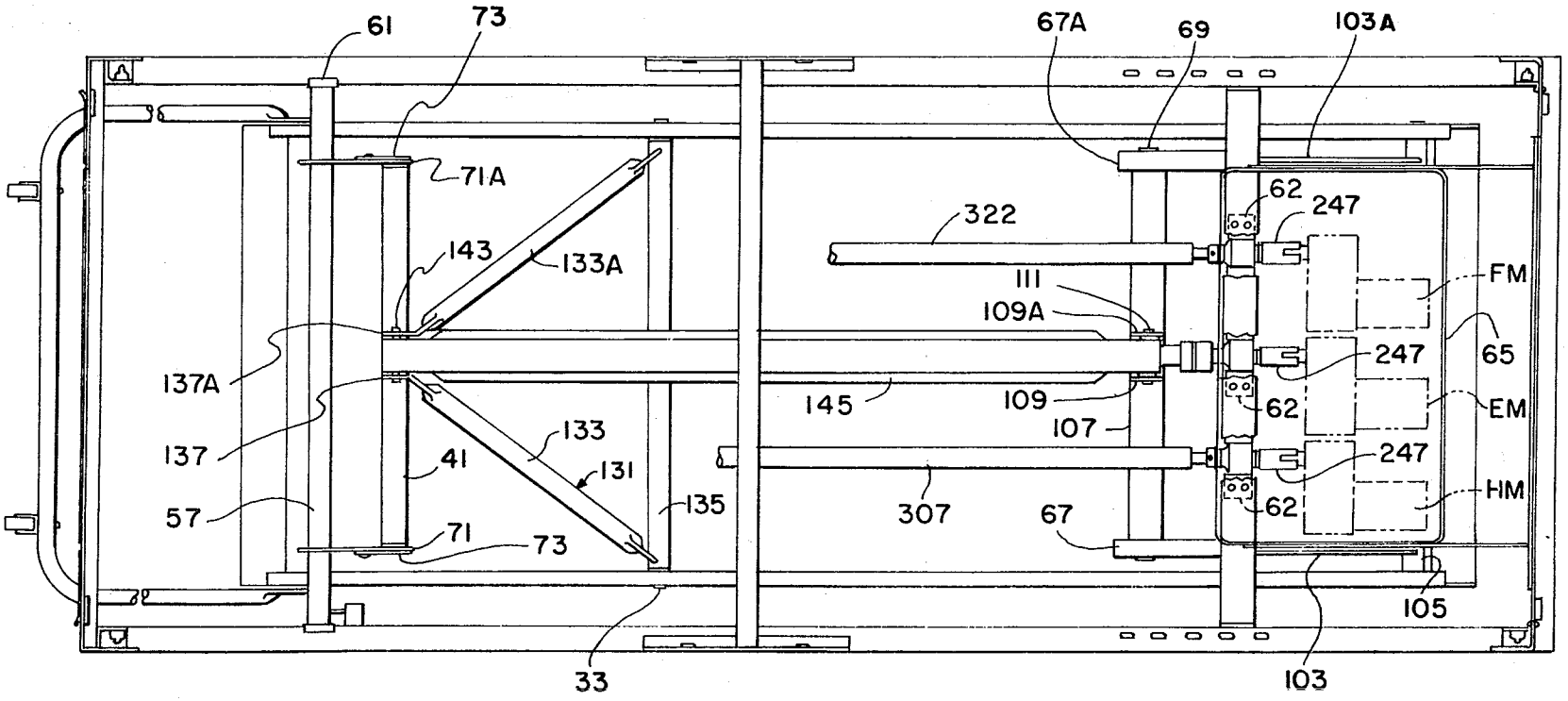
FIG. 5 is a plan view partially cut away and with parts omitted for clarity of illustration of the illustrative embodiment of FIG. 1.
Figure 9:
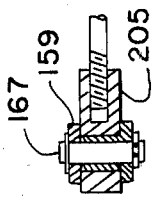
FIGS. 7, 8 and 9 are section views taken on Lines 7—7, 8—8, and 9—9 of FIG. 6.
Figure 8:
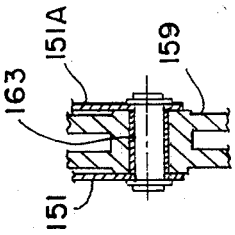
Figure 7:
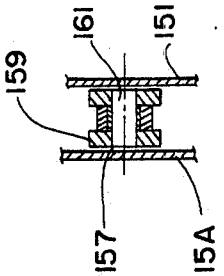

The curves A, B, and C in the graph of FIG. 22 represent the ratio of mechanical advantage or disadvantage over the vertical bed height range for various parallelogram lifting arrangements. Each curve was empirically plotted by comparing the vertical bed height travel in increments of ½ inch to the amount of screw travel for each increment, i.e.: a total of 34 increments.

Curve A is the ratio curve for the parallelogram lifting mechanism with the elevate drive tube connected directly (not shown) to the drag link, and the screw travel equal to the drag link travel. Curve A shows the mechanical disadvantage to be approximately 0.2 to 1 for the first one-half inch of vertical bed travel. The ratio of 0.2 to 1 may also be expressed as 1 to 5. The mechanical disadvantage slowly decreases along curve A as the bed reaches the maximum travel height. At 17 inches travel, curve A shows the mechanical disadvantage to be 0.5 to 1, or 1 to 2. If the curve were plotted in small enough increments the mechanical disadvantage would be 1 to 4.6 in the starting position and 1 to 1.9 in the 17 inches height position.

Curve B is the ratio curve for the modification parallelogram lifting mechanism with the pulley and cable system as briefly described above. Curve B shows that the mechanical disadvantage is exactly one-half that of curve A. Curve B shows the mechanical disadvantage to the 0.4 to 1 or 1 to 2.5 for the first one-half inch of vertical bed travel, and gradually decreasing along curve B to a ratio of 1 to 1 as the bed reaches the maximum 17 inches of height travel.

Curve C is the ratio curve for the lifting mechanism shown in the illustrated and preferred embodiment, employing a bell crank and connecting rod lifting arm torque compensation arrangement. Curve C shows a mechanical advantage of 1.3 to 1 for the first ½ inch of travel, decreasing rapidly to about 0.65 to 1 or 1 to 1.53 mechanical disadvantage when the bed has raised 2 inches. The favorable overall mechanical advantage in the lowermost starting position is very desirable, and also counteracts the added inefficiency of the parallelogram caused by deflection as previously mentioned. As the bed continues to raise, the mechanical disadvantage gradually increases further to 0.56 to 1 or 1 to 1.78 when the bed has raised about 7 inches, and then gradually decreases still further to 0.7 to 1 or 1 to 1.42 as the bed raises the full 17 inches.

In comparison of the three types of mechanisms generally described above, it will be appreciated that a mechanism with a direct pull on the drag link can only lift a small proportion (e.g. approximately two-fifths) the load that the illustrative bell crank system embodiment can at the same motor speed, in approximately one-half the elapsed time. The pulley and cable system can only lift approximately seven-tenths the load that the bell crank system can at the same motor speed, in a slightly longer elapsed time. If the direct pull system is slowed down so that it will lift the load that the bell crank system can lift, the elapsed time is considerably increased to approximately 1.4 times the elapsed time required for the compensating bell crank system.

As discussed generally heretofore, a drive mechanism with a direct screw applied pull on the drag link has several disadvantages, one being the slower speed as described above. Another is that the pull on the elevate screw is much greater since the resultant pull on the drag link remains constant for a given load being lifted. An elevate screw connected directly to the drag link must be able to carry a tension load of approximately 2.8, ($0.56 \div 0.2 = 2.8$), times greater than that of the elevate screw with illustrative lifting arm and the bell crank mechanism. Likewise the sub-frame assembly 41, the foot end cross member 55, and the pivot support brackets 62 must be able to carry a load 2.8 times greater.

As mentioned before, the torque arms 109 and 109A transmit a torsional load into torque tube 107 and lifting arms 103 and 103A, to cause lifting arm 101 to raise the bed. Torque arms 109 and 109A also transmit a bending load into torque tube 107. In the illustrated and preferred embodiment, the bell crank/lifting arm torque compensation mechanism materially reduces this bending load on the torque tube, since the connecting rod 169 is connected directly to the torque tube 107 and supplies a counteracting force in approximately the opposite direction of the bending load. If, instead, a point on the sub-frame assembly 41 were selected for attachment of the connecting rod, all of the bending load in the torque tube 107 would remain.

MATTRESS SUPPORT SURFACE ARTICULATION

In the illlustrative and preferred embodiment according to the invention, the mattress supporting surface, 321A, 323A, 324A, 325A formed by the various movable mattress support sections 321, 323, 324, 325 is adapted to be moved into various treatment positions independently of the vertically stationary base 21, lifting mechanism, and bed height.

It is conventional practice in hospital beds, that the mattress supporting surface conventionally includes a movable leg section, and the head or back section and the thigh section are driven to articulated positions with a motor or a hand crank. The leg section is generally adjusted manually with a ratcheting type of pivoted leg brace.

It is a feature according to one important aspect of this invention that the seat section 321 is pivotally or angularly movable, as on support brackets 49, 49A therefor, making it possible to achieve Trendelenburg and Reverse Trendenlenburg with the mattress supporting surface in a straight line.

The mattress support subframe assembly 41 may be suitably formed of an angle iron rectangular frame with fixed seat section support brackets 49, 49A secured, as by welding, to both sides of the frame. The support brackets 49, 49A are mirror images of one another, and are each provided with two pivot pins 301 and 302 for dual pivotal mounting of the movable seat section assembly 321 through pivotal supporting engagement of the pins 301, 302 with slots 303, 304 formed in each of seat rocker panels 321R. The curved slotted holes 303 and 304 mount on pivot pins 301 and 302 respectively. The movable seat section can rotate on pivot pin 301, and slot 304 accommodates pivotal movement for a desired degree (e.g. 12°) of Trendelenburg. The movable seat section 321 can also rotate on pivot pin 302, and slot 303 accommodates a desired degree (e.g. 8°) of Reverse Trendelenburg. Slot 304 is an arc with a radius about pin 301. Slot 303 is an arc with a radius about pin 302. The seat section is rotated or pivotally rocked by means of an electric head motor and gear reduction unit 305 (having a head motor HM), a head drive screw 306, a head drive tube and nut assembly 307, a head cam drive assembly 308, (including cam drive links 308' fixedly interconnected for joint movement by a cross tube or shaft 308''' on which cam 308'' is fixed), and selector bars 309. The seat section is also rotated or pivotally rocked by means of an electrical foot motor and gear reduction unit 305A (including a foot motor FM), a foot drive screw 306A, a foot drive tube and nut assembly 322, a foot cam drive assembly 308A, (including cam drive links 308A' fixedly interconnected for joint movement through a cross tube or shaft 308A''' on which cam 308A'' is fixed), and selector bars 309. As the dual pivot support brackets 49, 49A, and the supporting and interconnecting structure and operational aspects of the seat section are mirror duplicates on the two opposite lateral sides of the seat section as it is supported by the support brackets on subframe 41, and as the various operating cam drives 308 and 308A operate on cross-interconnected and concurrently movable mirror image parts on both lateral sides of the articulated support sections 321, 323, 324, 325, the operation of the seat and other articulated sections and their related connecting parts will be described, for simplicity, with respect to only one lateral side of the bed with its seat and other articulated support sections, as to all motions of the mattress supporting surface 321A, 323A, 324A, 325A.

Figure 14:
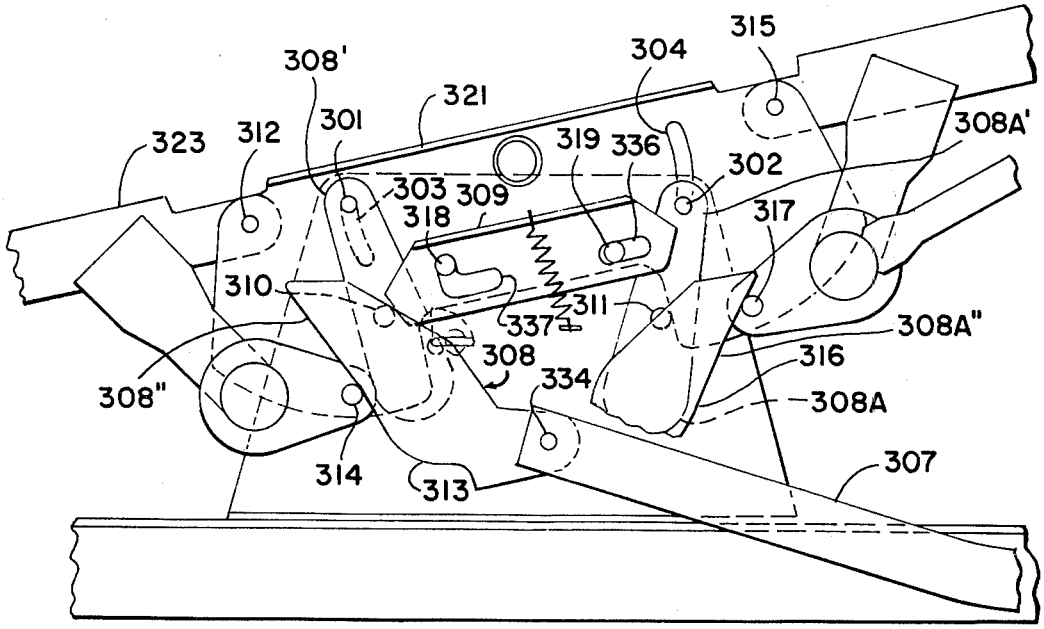

TRENDELENBURG MOTION (Seat Section) — (See FIG. 14)

As the head drive tube 307 retracts it pulls on the head cam drive assembly 308. Pin 310 on the head cam drive assembly 308 contacts the selector bar 309 which is mounted on the dual pivoted rocker panel 321R of the movable seat section 321, causing it to rotate about pin 301 and travel in slot 304, as previously described.

The lower limit switch HDL, which is (as are all other limit switches), preferably a motor revolution count responsive rotational cam operated switch, in the head motor and gear reduction unit 305, cuts off power to the head motor HM when the design maximum (e.g. 12°) of Trendelenburg is reached.

Figure 13:
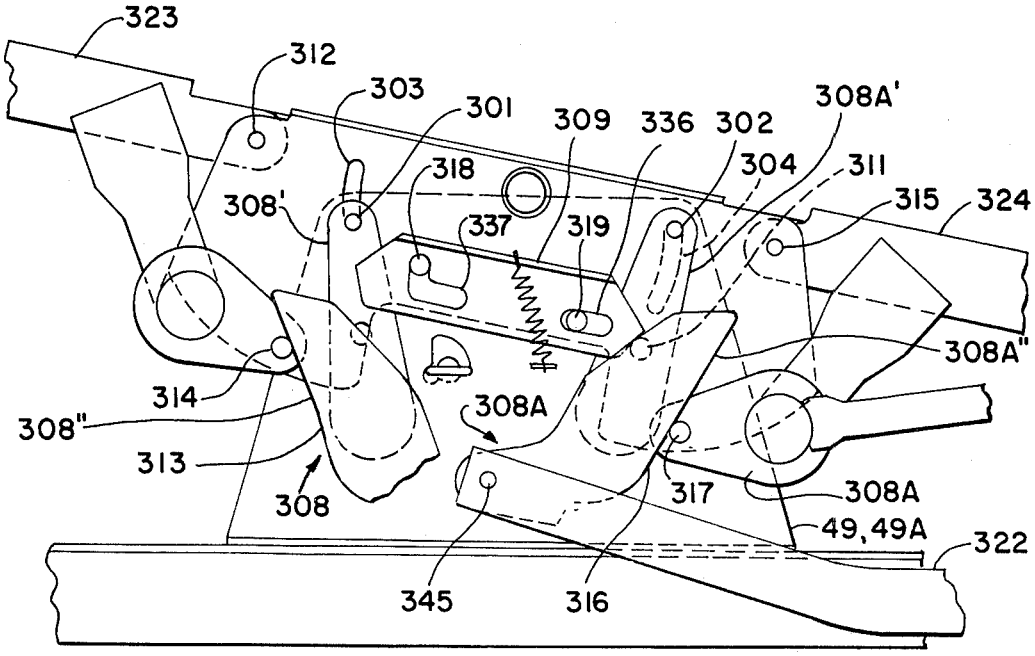
FIGS. 13 and 14 are schematic illustrations showing the articulation-effecting arrangement in Reverse Trendelenburg and Trendelenburg treatment positions.

REVERSE TRENDELENBURG MOTION (Seat Section) — (See FIG. 13)

As the foot drive tube 322 extends, it pushes on the foot cam drive assembly 308A. Pin 311 on the foot cam drive assembly 308A contacts the selector bar 309 causing the seat section 321, through its dual pivoted rocker panel 321R, to rotate about pin 302 and travel in slot 303. The lower or down limit switch FDL in the foot motor and gear reduction unit 305A stops the motion when the design maximum (e.g. 8°) of Reverse Trendelenburg is reached.

For simplicity of explanation, so far, only the movable seat section 321, and what causes it to move, has been described.

BACK AND THIGH SECTIONS

The head section 323, forms an articulated mattress-supporting surface 323A which in the illustrative embodiment is a sheet metal pan fabric, although other mattress-supporting surfaces may be used, such as articulated wire springs, as will be appreciated. Back mattress-supporting surface 323A is allowed to rotate about pivot pin 312. As the head drive tube 307 extends, it causes the head cam drive assembly 308, including cam drive link 308' and cam 308" fixed therewith on cross tube or shaft 308''' to rotate about pivot pin 301. The cam surface 313 in contact with cam follower pin 314 (which is preferably freely rotatable, to reduce wear) on the back section causes the back section 323 to rotate about pin 312. As the back or head section 323 rotates to a maximum of 80°, pin 314 rotates, slides, or otherwise rides, down the lower cam surface 313. The up limit switch HUL (which is also actuated at a given selected maximum number of motor shaft revolutions in one direction relative to start limit point (HDL actuation point) in the opposite direction) in the head motor and gear reduction unit 305 stops the motion when the back section 323 is at a selected maximum (e.g. 80°) above horizontal. When the head section 323 returns to level, an intermediate (level) limit switch HI/LL, which is cam-operated by a shaft rotational position in the gear reduction box of motor drive unit 305, stops the travel when the head section 323 is level (zero degrees) relative to seat section 321.

The thigh section 324 forms a mattress-supporting surface 324A, and is allowed to rotate about pivot pin 302 forming a pivoted interconnection with seat section 321. As the foot drive tube 322 retracts, it causes the foot cam drive assembly 308A, including cam drive link 308A', and cam 308A", fixed therewith, to rotate about pin 302. The cam surface 316 in contact with cam follower pin 317 (which is preferably freely rotatable, to reduce wear) on the thigh section 324 causes the thigh section 324 to rotate about pin 315. As the thigh section 324 rotates a selected maximum (e.g. 35°), cam follower pin 317 rotates, slides, or otherwise rides down the lower cam surface 316. The motor shaft revolution responsive up limit switch FUL in the foot motor and gear box assembly 305A stops the motion when the thigh section 324 is at the selected maximum angle (e.g. 35°) above the level position relative to the seat section, which is level unless articulated for Trendelenburg or Reverse Trendelenburg or other seat section motor positions. An intermediate level limit switch FI/LL stops the travel when the thigh section 324 returns to level (zero degree) relative to the seat section.

A flexible-cable-connected hand-held electric patient pendant control PC may be located at either side of the seat section and stored in a flexible wire pendant holder 353 which may be selectively inserted in any of the seat section sockets 341, 341A or the corner IV sockets 351 at the head end of the bed. This patient control pendant PC permits patient or nurse control of only the movement of the head section 323 and the thigh section 324 at and above the horizontal.

Closing of the "HEAD UP" switch contacts PIA, PIA2 allows the patient to run the back section 323 to a selected maximum (e.g. 80°) above level relative to the seat section, and if the seat section is at horizontal, this will be 80° above horizontal. Cut off of head motor HM at the maximum up position is effected by cam opening of limit switch HUL.

Closing of the "HEAD DOWN" switch contacts PIA, PIA1 allows the patient to run the head section 323 down to level relative to the seat section.

The "FOOT UP" function allows the patient to run the thigh section 324 to 35° above horizontal.

The "FOOT DOWN" function allows the patient to run the thigh section 324 down to level.

If the seat section 321 is in other than the horizontal position for a special nurse control position, or if patient control is otherwise undesirable, the nurse may selectively disconnect patient control pendant PC by opening Pendant Lock Out Switch P/LO.

LEG SECTION

The leg section 325 is a mattress-supporting surface that pivots on points 326 of the thigh section 324. The leg section 325, is manually adjustable by means of an adjustable leg brace 327. The tang 328 on the leg brace 327, which pivotally depends from the leg section 325, is engaged in any of the adjusting slots 329, 330, 331, 332, and 333. Slot 329 is positioned to support the leg section in the level position and also with the thigh section 324, slightly raised. Slot 333 is positioned for the maximum 12° Trendelenburg position. Slots 330, 331, and 333 are positioned for lesser degrees of Trendelenburg and in conjunction with varying degrees of movement of the thigh section 324 above horizontal. A sixth position with the tang 328 disengaged, is used to lower the leg section 325 below horizontal for Reverse Trendelenburg. The leg brace 327 pivots on point 320 of the leg section 325.

THE COMPLETE TRENDELENBURG MOTION (See FIGS. 14 and 14A)

The "TRENDELENBURG MOTION", previously described, only covered what causes the seat section 321 to rotate into maximum (e.g. 12°) Trendelenburg. The following description describes the operation of the back section 323 and the thigh section 324, as the seat section 321 rotates when the Trendelenburg "IN" switch S1 on the nurse control panel NCP is closed.

Assume the mattress-supporting surface formed on either end of the seat section 321, by back, thigh, and leg sections 323, 324, 322, is in any random gatched position, not necessarily flat, as outlined below:

1. The back section 323 is at any point from level to maximum (e.g. 80°) above horizontal.
2. The thigh section 324 is at any point from level to maximum (e.g. 35°) above horizontal.
3. The leg section 325 is in any position.
4. The seat section 321 is in the horizontal position.
5. The mattress-supporting surface is at any height from the floor.

To cause the mattress-supporting surface 325A, 324A, 321A, 323A, to go into Trendelenburg, the operator pushes the pushbutton double pole momentary contact Trendelenburg "IN" switch S1 on the nurse control panel NCP. This closes contacts S1A, S1A2, S1B, S1B2, and completes the down circuit to the head motor HM and the level circuit to the foot motor FM. The foot motor FM and foot motor and gear reduction unit 305A will run in the down direction until the level limit switch F1/LL (which is shaft rotation position-responsive) for the foot motor drive unit 305A opens, causing the thigh section 324 to stop in the level position (zero degrees) relative to the seat section mattress support surface. If the thigh section 324 happens to be initially in the level position the foot motor FM will not run. Assuming the thigh section 324 is at some angle above horizontal the foor motor FM runs in the down direction causing the foot drive tube and nut assembly 322 to extend and push on the cam drive assembly 308A and causing the cam drive link 308A' and cam 308A" fixed therewith, to rotate about pin 302. The cam follower pin 317, fixed in depending relation from the thigh section 324, rolls, slides, or otherwise rides up the cam surface 316, allowing the thigh section 324 to rotate about pin 315 until the level limit switch FI/LL in the foot motor and gear reduction unit 305A opens.

The head motor HM in this instance will also run in the down direction at the same time the foot motor 305A is running. Assuming the head section 323 is at some angle above horizontal, the head motor HM runs in the down direction, causing the head drive tube and nut assembly 307 to retract and pull on the head cam drive assembly 308, causing cam drive 308' to rotate about pivot pin 301. The cam follower pin 314 fixedly depending from the head section 323, rolls up the cam surface 313, allowing the head section 323 to rotate about pin 312. The down limit switch HDL in the head motor and gear reduction unit 305 is opened at a further "down" extent of rotation of head motor HM, and thus allows the head motor HM to continue running in the down direction, past the level limit switch. This causes the head cam drive assembly 308 to continue to rotate about pivot pin 301. Pin 320 on the head cam drive assembly 308, contacts the selector bar 309 which is mounted on the movable seat section 321.

Selector bar 309 acts as a stop, or a secondary, selectively defeatable, force-transmitting pick-up point, on the movable seat section 321. If hyperextension or other analogous lowering of one or both of the thigh and head sections 324 and 323 were not desired, for a given use, selector bar 309 could be replaced by a fixed stop bar, pin, or pins, on the movable seat section 321 dual pivoted rocker panel 321R. As the cam drive assembly 308 continues to rotate about pivot pin 301, pin 310, in contact with selector bar 309, causes the seat section 321 through its rocker panel 321R, to also rotate about pivot pin 301, and slot 304 permits this angular movement relative to pivot pin 302. Once contact between pin 310 and selector bar 309 has been made, the respective relationship between the cam drive assembly 308 and the seat section 321 remains the same as they continue to rotate about pivot pin 301. At the time pin 310 contacts selector bar 309, pin 314 is in contact with a predetermined point on cam surface 313 where the mattress-supporting surface of the head section 323 is in a straight line relationship between pivot pin 312 on the movable seat section 321, and the cam follower pin 314 in contact with cam surface 313 also remain substantially constant. Thus, as the movable seat section 321 and the cam drive assembly 308 continue to rotate about pivot pin 301, the straight line relationship of the mattress-supporting surfaces of the head section 323 and the seat section 321 is substantially maintained.

When the foot cam drive assembly 308A is in the foot motor level limit switch FI/LL position, the upper cam surface 316 is theoretically an arc generated by a radius about pin 301. In practice, this radius arc may be satisfactorily replaced, if desired, by a straight line curve, particularly to effectively increase the radius slightly at the top portion of the cam surface 316, in order to compensate for the necessary clearance between pin 310 and selector bar 309 in the level position.

With the movable seat section 321 in the level position and foot cam drive asembly 308 in the level position, pin 317 is in contact with a predetermined point on cam surface 316 where the mattress-supporting surface of the thigh section 324 is in a straight line relationship with the mattress-supporting surface of the seat section 321.

As the movable seat section 321 rotates about pivot pin 301, pin 315 generates an arc about pin 301. Since the upper end of cam surface 316 is also an arc (or satisfactory modification such as discussed above) about pivot pin 301, the straight line relationship between the seat section 321 and the thigh section 324 remains substantially constant, (or, if modified as discussed above, remains satisfactorily near constant) as the cam follower pin 317 rolls up the upper cam surface 316.

Regardless of the starting position of the head section 323 and the thigh section 324, when the Trendelenburg motion is initiated, the mattress-supporting surfaces 323A, 321A, and 324A of the head, seat, and thigh sections 323, 321, 324 will finally end up in a predetermined inclined substantially straight line relationship. For example, if the head section 323 is level and the thigh section 324 is at some angle above horizontal when the Trendelenburg motion begins, the head section 323 will start to move below horizontal before the thigh section 324 is in a straight line relationship with the seat section 321. Through continued running of the foot motor FM until its level limit switch F1/LL is opened, the cam follower pin 317 on the thigh section 324 will eventually end up at a point on the upper end of cam surface 316 which effects a substantially straight line relationship between the seat section 321 and the thigh section 324.

The Trendelenburg motion causes the mattress-supporting surface 324, 321, 323 to tilt in a head down position to the selected maximum (of e.g. 12°), with the head or head section 323, the seat section 321, and the thigh section 324 in an inclined straight line relationship.

The degree of Trendelenburg can be adjusted to any position between zero and the design maximum (e.g. 12°), by means of depressing or releasing the push button, self-opening, momentary contact Trendelenburg "IN" switch S1 on the nurse control panel NCP. The down limit switch HDL in the head drive motor and gear reduction unit 305 will automatically stop the motor at 12°, or other preset maximum extent of Trendelenburg.

TRENDELENBURG AND REVERSE TRENDELENBURG INDICATOR

The pivot pins 301 and 302 on fixed outside seat support brackets 334 and 334A provide the dual supporting pivot or rocker points for the dual pivoted rocker panel of tiltable seat section 321. The fixed seat supports 334 and 334A are provided with slotted windows W spaced a distance below pivot points 301 and 302. Dual pivoted seat section rocker panel 321R is provided with numerical indicia under each of the four windows W. Each set of numerical indicia may bear suitable numbers such as 0, 2, 4, 6, 8, 10, and 12 arranged in an arc with a radius about a respective pivot pin 301 and 302. External indicia may be affixed to the seat support brackets 334 and 334A, labeling the window under pin 301 "DEGREES TRENDELENBURG" and the window under pin 302 as "DEGREES REVERSE TRENDELENBURG". As the movable seat section 321 rotates about pivot pin 301, the appropriate number of degrees traveled appears in the Trendelenburg window. As the seat section 321 rotates about pivot pin 302, the appropriate number of degrees traveled appears in the Reverse Trendelenburg window. This can be observed from either the right or left hand side of the bed.

LEG SECTION ADJUSTMENT IN TRENDELENBURG

After the desired degree of Trendelenburg has been attained by depressing the Trendelenburg "IN" switch S1, the leg section 325 may be manually adjusted in a straight line relationship with the back, seat, and thigh sections 323, 321, 324 by means of engaging the tang 327A on the leg brace 327, in the appropriate slots 330, 331, 332, or 333.

To return the mattress support surface 323A, 321A, 324A to level position, the operator closes the Trendelenburg "OUT" switch S2 and holds this closed until the head, seat and thigh sections 323, 321 and 324 are again level. Also, preparatory to moving the mattress support surface to Reverse Trendelenburg position, the operator first returns the motor driven mattress support surfaces to the level position. The leg section 325 is first manually adjusted to the level position by engaging tang 327A on leg brace 327 in a suitable slot 329. The momentary push button type contact Trendelenburg "OUT" switch S2 is closed until the motor driven mattress support sections 323, 321, 324 are level. Since closure of the Trendelenburg "OUT" switch S2 completes the heat motor energization circuit thrugh Up limit switch HUL, the head motor HM will continue running in the up direction past the intermediate level limit switch stop position of switch H1/LL, and the back section 23 will continue to travel above horizontal if the "OUT" switch is maintained, although the thigh section 324 (which is returned by gravity as selector bar 309 bears against pin 310 and cam follower pin 317 follows against stationary cam 316) will stop at horizontal with the seat section 321. For exact level adjustment the operator can run the head or head section 323 slightly above horizontal and then close the "HEAD DOWN" switch contacts P1A, P1A1 on the patient control PC, and the head section 323 will automatically stop at the level position through opening of the intermediate level limit switch H1/LL at the level rotational position of the motor HM.

When the Trendelenburg "OUT" switch is depressed it completes the circuit to the head motor 305, through the up limit switch HUL. The head drive tube assembly 307 extends, causing the head cam drive assembly 308 to rotate about pivot pin 301. Pin 310 on cam drive assembly 308 is backing in a direction away from selector bar 309. Selector bar 309 follows pin 310 until the seat section 321 returns to level relative to seat section 321. Cam surface 313 bearing against cam follower pin 314 causes head section 323 to return to level in a straight line relationship with seat section 321. As seat section 321 rotates about pin 301, cam follower pin 317 rolls down cam surface 316, returning the thigh section 324 back to the level position.

THE COMPLETE REVERSE TRENDELENBURG MOTION (See FIGS. 13 and 13A)

Again, the mattress supporting surface can be in any random position of the nature as described for Trendelenburg.

To cause the mattress supporting surface to go into Reverse Trendelenburg the leg section 325 should first be lowered by disengaging the leg brace 327 completely, i.e., the tang 327A is not engaged in any of the slots 329–333. This is done first, mainly for the comfort of the patient since his legs only bend in one direction at the knee. This also enables unimpeded free gravity return of the thigh and seat section to the level position as the head section is raised to level position. The operator then depresses and closes the push button momentary contact Reverse Trendelenburg "IN" switch S1 on the nurse control panel NCP. This completes the down circuit to the foot motor FM through limit switch FDL, and the level circuit to the head motor HM through limit HI/LL. The head motor HM will run in the down direction until the circuit is opened by the level limit switch HI/LL at the level position of the head section 323 with the seat section 321. The foot motor FM will run in the down direction until the circuit is opened by the down limit switch FDL at preset maximum (e.g. 8°) Reverse Trendelenburg.

The motions for Reverse Trendelenburg are similar to that of Trendelenburg, and are not separately described, since the seat section, seat tilt, cam and cam follower parts are essentially effectively symmetrical and operate in the same manner, in reverse, about the longitudinal center of the seat section.

OUT OF REVERSE TRENDELENBERG (to return the motor driven mattress support sections to the level position)

The operator depresses and closes the momentary contact Reverse Trendelenburg "OUT" switch S2 until the mattress support surfaces are level. Again, the "OUT" switch S2 can be maintained until the thigh section 324 is slightly above level and returned to exact level by closing the "FOOT DOWN" switch contacts P1B, P1B1 on the patient pendant control PC. The thigh section 324 will automatically stop at level with the seat section 321. Finally, the leg section 327 is readjusted to level by engaging tang 327A on leg brace 327 in slot 329.

Figure 15:
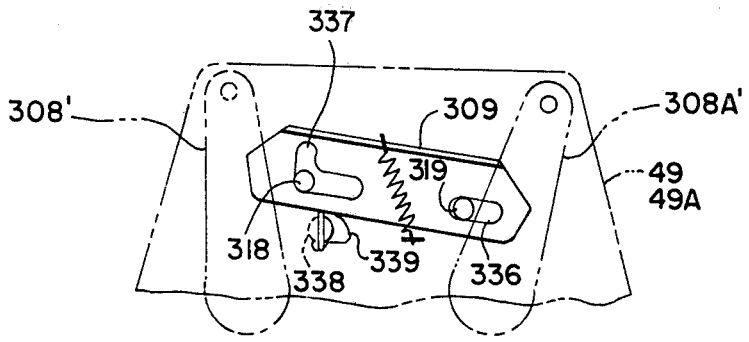
FIGS. 15, 16 and 17 illustrate schematically successive steps in reaching hyperextension treatment position.
Figure 16:
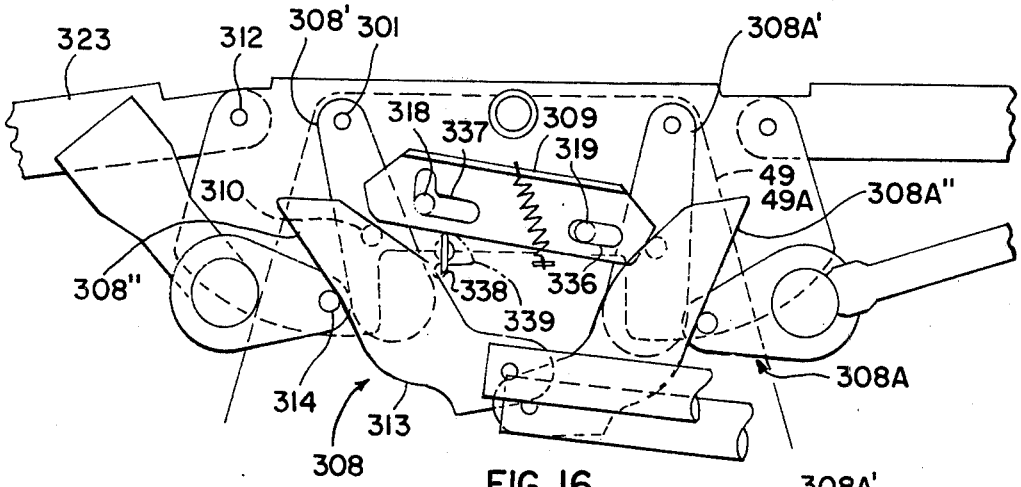
Figure 17:
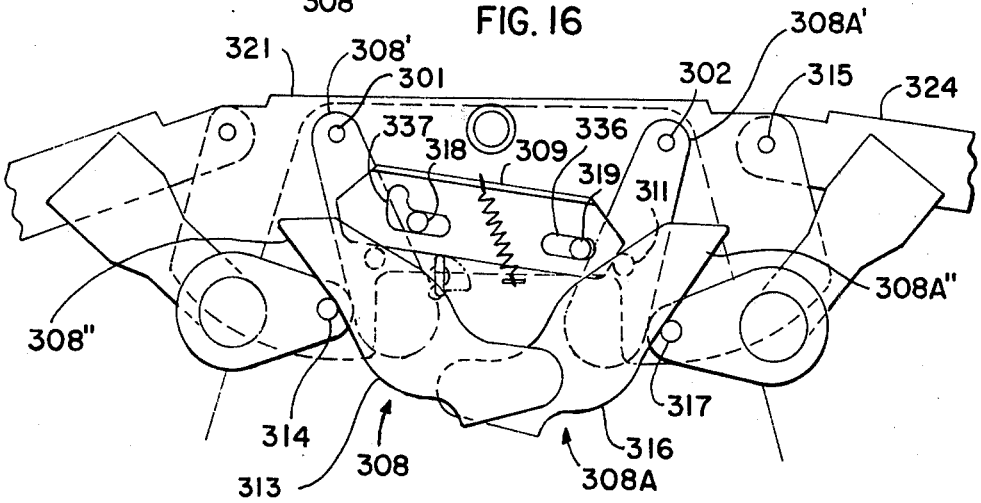
Figure 18:
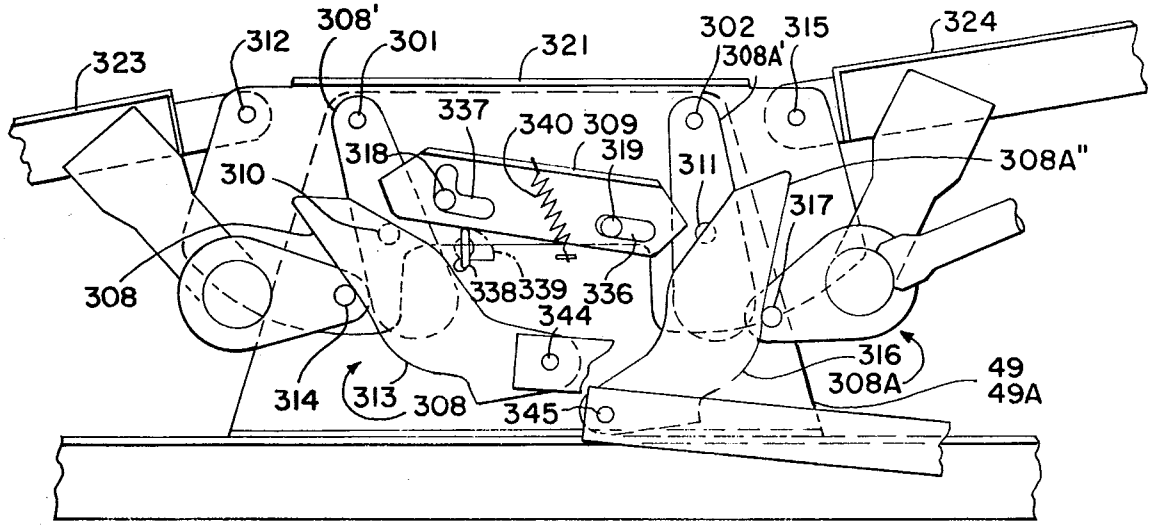
FIG. 18 is a schematic view illustrating Spring Trendelenburg, with the back section tilted down, thigh section up, and the seat section level.
Figure 19:
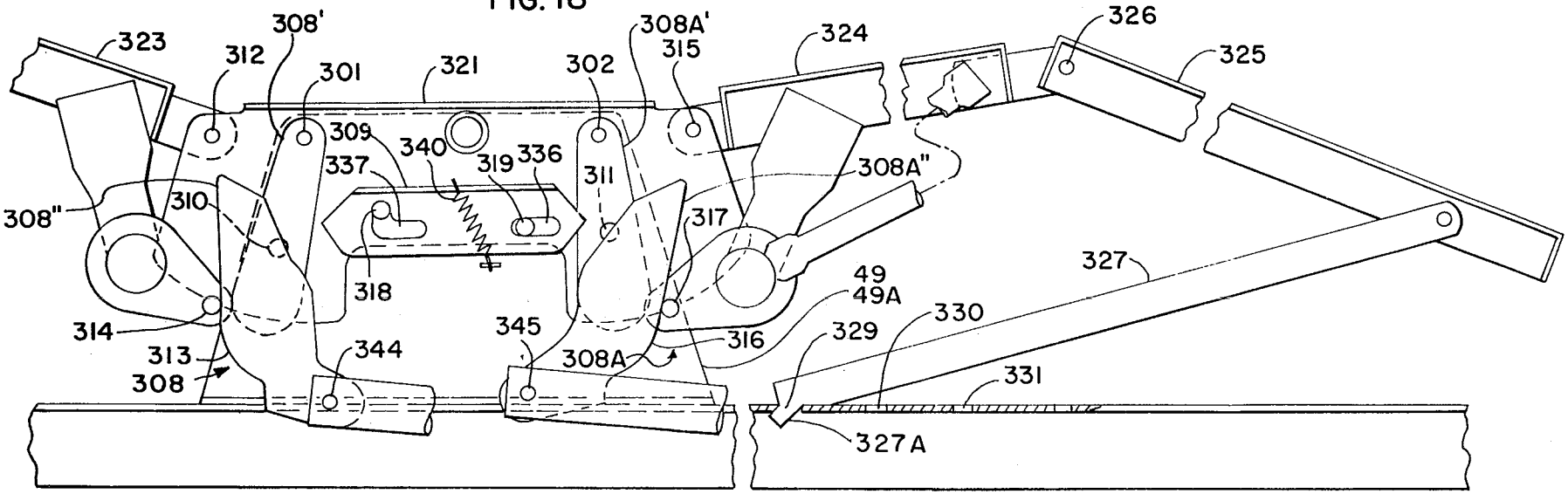
FIG. 19 is a schematic view illustrating a gatched position with knee up, leg down, back up, and seat level.
Figure 20:
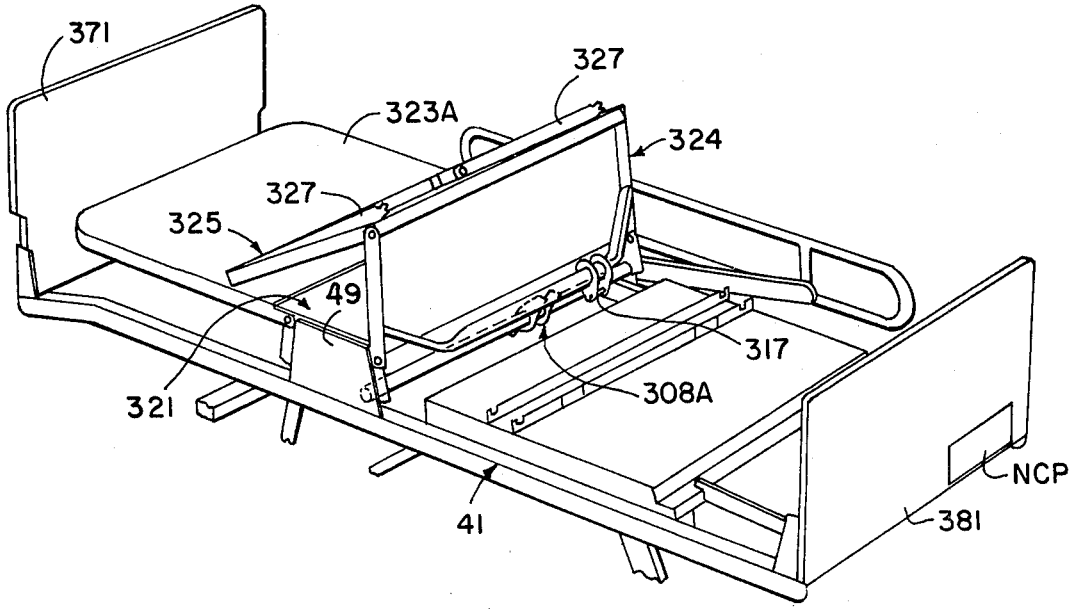
FIGS. 20 and 21 are schematic views illustrating the articulated manual raising of the foot and thigh sections (FIG. 20) and the head section (FIG. 21) for cleaning or other maintenance.
Figure 21:
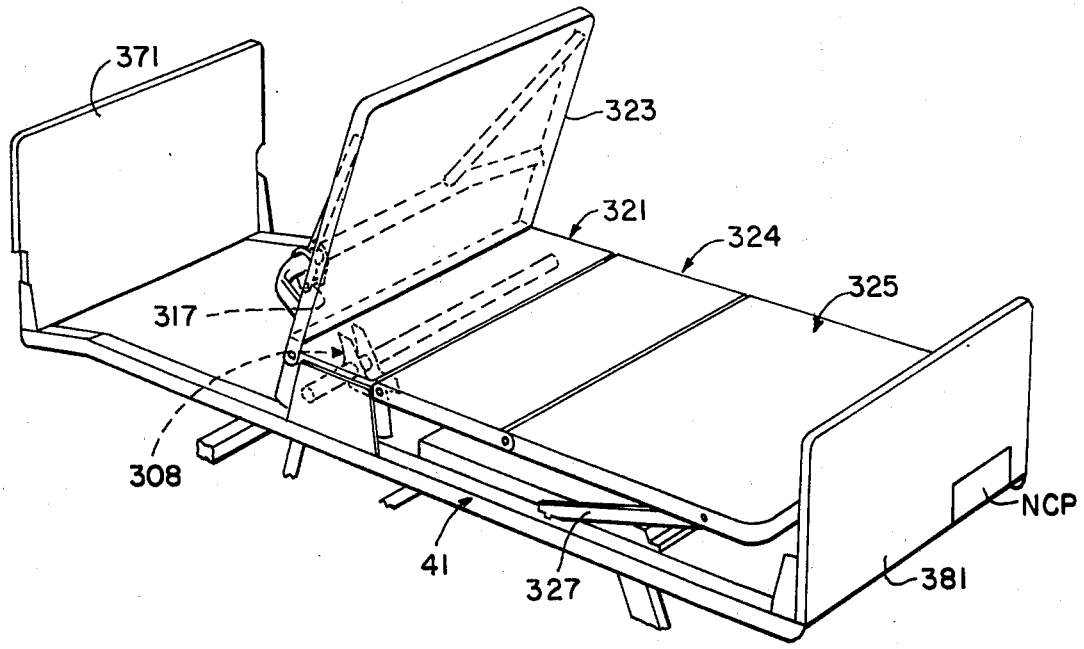
Figure 23:
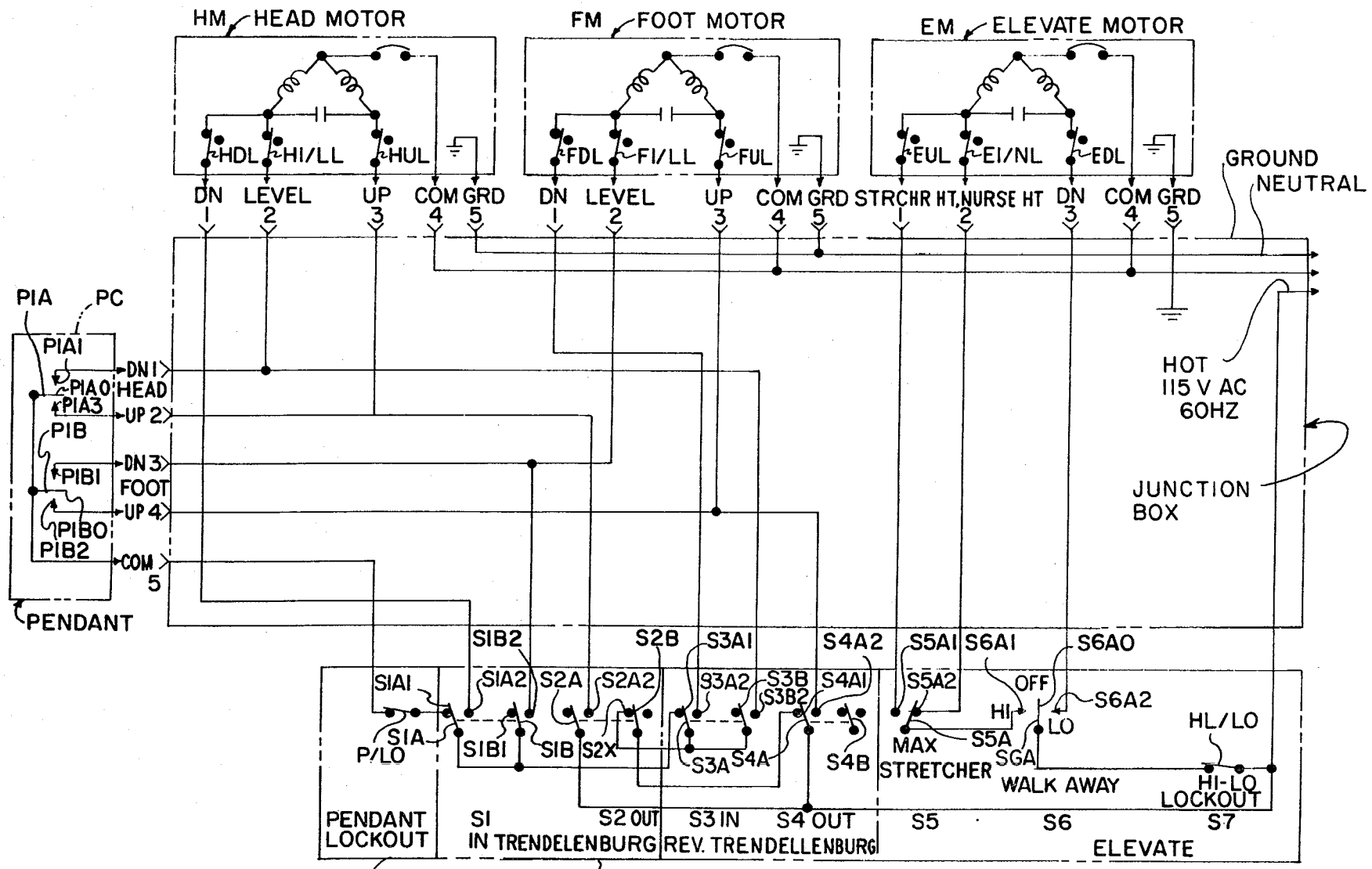
FIG. 23 is an electrical schematic of an illustrative embodiment control circuit for the illustrated bed.

HYPEREXTENSION (or flex position) (See FIGS. 15, 16 and 17)

As mentioned before, selector bar 329 acts as a stop medium mounted on the movable seat section 321. Selector bar 309 is mounted on two pins 319, 319 fixed, as by welding, to the seat section rocker panel 321R, as by means of two flange headed screws and a keeper 335. Selector bar 309 is free to slide along its own slots 336 and 337. Forwardly and downwardly acting tension spring 340 is secured between selector bar 309 and the seat section side plate, and acts to resiliently maintain selector bar 309 in its horizontal down position, which is parallel with the mattress support surface of the seat section. It is in this position that it acts as a stop and motion transmitting medium. It is to be noted that a small clearance (e.g. 1/16 inch) exists between the pins 314 and 317 and the respective interfacing opposite ends of selector bar 309 when the seat section 321 is horizontal and the thigh and head sections are also horizontal (or a larger respective clearance when either head or thigh section 323 or 324 is above horizontal). This is important in enabling freedom of up and down movement of the selector bar 309, particularly for the hyperextension motion next to be described.

In the hyperextension position it is necessary to have the head section 323 below horizontal and also the thigh section 324 below horizonal without affecting the seat section. In order to accomplish this, it is necessary to effectively prevent selector bar 309 from acting as an effective stop and blocking the path of pins 310 and 311, which stop or blocking action would permit tilting action to be applied to the seat section, and no seat tilting is desired for this operation. Selector bar defeat means is provided by trip rod 338. This position of selector bar 309 is manually altered by rotating laterally protruding trip rod 338, approximately 90° in aligned special quadrant slots 339, formed in the seat support brackets 334 and 334A. Trip rod 338 is preferably a tube flattened at both ends and protruding through seat supports 334 and 334A. The ends of trip rod 338 are formed up to provide an exterior handle 338A at each end for manual grasping and rotation. The flattened ends of trip rod 338 provide a camming action on selector bar 309 as the trip rod 338 is rotated in slot 339, causing the selector bar 309 to pivot about point 319 in slot 336 and to be raised in slot 337 at point 318. Friction between selector bar 309 and trip rod 338 causes trip rod 338 to stay in position and hold selector bar 309 in the raised position.

To put the mattress supporting surface into hyperextension the operator first lowers the leg section 325 by disengaging the leg brace 327. The operator then manually fully rotates the trip rod 338 in special quadrant slots 339, through approximately a quarter turn to a slightly over-center self-holding position which is labeled "Hyperextension IN" on the exterior surface of seat support 334 and 334A. This can be done from either side of the bed. The operator then depresses the Trendelenburg "IN" switch S1 and the Reverse Trendelenburg "IN" switch S3 on the nurse control panel or vice versa, but depressing both at the same time will be of no added value, because closing the Reverse Trendelenburg "IN" switch S3 opens and locks out the Trendelenburg "IN" switch S1 electrically by opening contacts S3A and S3A1. The sequence of closing switches S1 and S2 is optional, as the ultimate result will be the same in either case.

Closing the TRendelenburg "IN" switch S1 completes the circuit to the head motor HM through the down limit switch HDL, causing the head drive tube 307 to retract and pull on the head cam drive assembly 308, causing it to rotate about pivot pin 301. Since selector bar 309 is in the raised position, it does not block the path of pin 310, which would normally cause the movable seat section 321 to rotate. As head cam drive assembly 308 rotates about pivot pin 301, cam follower pin 314 rolls up the cam surface 313 and allows the back section 323 to rotate on pivot pin 312, causing the head section 323 to rotate to a suitable angle (e.g. approximately 10°) below horizontal until the down limit switch HDL in head motor and gear reduction unit 305 opens. A lesser inclination angle can be obtained by releasing and thus opening the pushbutton self-opening Trendelenburg "IN" switch S1 at any time.

Closing the pushbutton self-opening Reverse Trendelenburg ∓IN" switch S3 completes the circuit to the foot motor FM, through the down limit switch FDL, causing the foot drive tube 322 to extend and push on the foot cam drive assembly 308A, causing it to rotate about pivot pin 302. Since selector bar 309 is in the raised position, pin 311 causes selector bar 309 to move forward in slot 336 and the lower leg of slot 337, thus not blocking the path of pin 311, which would normally cause the movable seat section 321 to rotate. As the foot cam drive assembly 308A rotates about pivot pin 302, cam follower pin 317 rolls up cam surface 316 and allows the thigh section 324 to rotate on pin 315, causing the thigh section 324 to rotate to a suitable angle (e.g. approximately 8°) below horizontal until the down limit switch FDL in foot motor and gear reduction unit 305A opens. A lesser angle can be obtained by releasing and thereby opening the Reverse Trendelenburg "IN" switch S3 at any time.

OUT OF HYPEREXTENSION

To return the head or back section 323 and the thigh section 324 to level the operator depresses the Trendelenburg "OUT" and Reverse Trendelenburg "OUT" switches S2, S4 in the nurse control panel NCP either independently or simultaneously. Closing the Trendelenburg "OUT" switch S2 completes the up circuit to the head motor HM through Up limit switch HUL, causing the head drive tube 307 to extend and rotate the head cam drive tube assembly 308 about pivot pin 301. The cam follower pin 314 rolls down cam surface 313, causing head section 323 to rotate about pin 312, causing the back section 323 to rotate in the up direction toward level. If the Trendelenburg "OUT" switch S2 is maintained closed, the back section 323 will continue to travel in the up direction above horizontal until the upper limit switch HUL is cammed open at the maximum head up position. To level the back section 23 exactly, the operator can run the back or head section 323 slightly above horizontal and then run the back or head section 323 down with the "HEAD DOWN" switch PIA on the patient control pendant PC, and the back section 323 will automatically stop at level through the action of the level limit switch HI/LL in the head motor and gear reduction unit 305.

Closing the Reverse Trendelenburg "OUT" switch S4 completes the up circuit to the foot motor FM through up limit switch FUL, causing the foor drive tube 322 to retract and rotate the foot cam drive assembly 308A about pivot pin 302. The cam follower pin 317 rolls down the cam surface 316, causing the thigh section 324 to pivot about pin 315 and causing the thigh section 324 to pivot in the up direction towards level. If the pushbutton Reverse Trendelenburg "OUT" switch S4 is maintained closed, the thigh section 324 will continue to travel in the up direction above horizontal to its upper limit position, as previously indicated concerning back section 323. To level the thigh section 324 exactly, the operator can run the thigh section 324 slightly above horizontal and then run the thigh section 324 down by closing with the "FOOT DOWN" switch PIB, PIB1 on the patient control pendant, and the thigh section will automatically stop at level through the action of the level limit switch FI/LL in the footmotor and gear reduction unit 305A. After the head and thigh sections are leveled, the operator manually adjusts the leg section 325 back to level by engaging tang 327A of leg brace 327 in a suitable slot (e.g. 329).

AUTOMATIC RESET OF HYPEREXTENSION TRIP ROD

As the thigh section 324 is returned to level, pin 311 in contact with selector bar 309 is backing in a direction away from selector bar 309. Spring 340 is exerting a vertically downward and a horizontally backward force on selector bar 309 causing it to slide along its slots 336 and 337. This rearward frictional dragging movement of selector bar 309 against the respective uptruned flattened ends of trip rod 338 causes trip rod 338 to tip over rearwardly as it passes top dead center. Trip rod 338 is now reset in the "Hyperextension OUT" position as indicated on the respective outer faces of the seat support brackets 334 and 334A. As the back of head section 323 returns to level, pin 310 rotates out from under selector bar 309, allowing selector bar 309 to return to its original horizontal position with the assistance of spring 340.

To repeat the hyperextension position, trip rod 338 must be manually reset one-quarter turn to the "Hyperextension IN" position, as described above.

While the invention has been illustrated and described with respect to a single illustrative and preferred embodiment, it will be apparent that various modifications and improvements may be made without departing from the scope and spirit of the invention. Accordingly, the invention is not to be limited to the illustrative embodiment, but only by the scope of the appended Claims.

We claim:

1. A height adjustable bed comprising a base, a vertically adjustable support frame vertically adjustable relative to said base, pivoted lifting arms pivotally connecting between said base and said vertically adjustable support frame, force application means for applying a lifting-movement-effecting torque to said pivoted lifting arms, said force application means having a power input zone, said force application means for applying a lifting-movement-effecting torque including intermediate torque compensation means in powertransmitting relation between said power input zone and said lifting arms for automatically applying a greater torque to said lifting arms in a lowered position than in a raised position of said lifting arms, for a given input power or torque applied at said power input zone.

2. A bed according to claim 1, said torque compensation means comprising a pivotally mounted bell crank, and connecting means for connecting said bell crank in variable torque-transmitting relation between said power input zone and said lifting arms.

3. A bed according to claim 2, said connecting means including a force-transmitting connection between one end of said bell crank and one of said lifting arms, and a second force-transmitting connection between another end of said bell crank and said power input means.

4. A height adjustable bed comprising a base, a vertically adjustable support frame vertically adjustable relative to said base, pivoted lifting arms pivotally connecting between said base and said vertically adjustable support frame, force application means for applying a lifting-movement-effecting torque to said pivoted lifting arms, said means for applying a lifting-movement-effecting torque including torque compensation means for applying a greater torque to said lifting arms in a lowered position than in a raised position of said lifting arms, said torque compensation means comprising a pivotally mounted bell crank, and connecting means for connecting said bell crank in variable torque transmitting relation between a power input means and said lifting arms, said connecting means including a force-transmitting connection between one end of said bell crank and one of said lifting arms, and a second force-transmitting connection between another end of said bell crank and said power input means, said connecting means further comprising a drag link, said bell crank being pivotally mounted on and carried by said drag link, and means pivotally connecting said drag link at spaced positions at each of said lifting arms.

5. A bed according to claim 4, said lifting arms connecting with said vertically adjustable support frame and said base in a pivoted parallelogram arrangement.

6. A bed according to claim 5, said drag link forming a parallelogram segment of another pivoted parallelogram torque-transmitting arrangement two segments of which are formed by respective segmental portions of said lifting arms.

7. A bed according to claim 6, said drag link being connected to said lifting arms at positions spaced above the pivotal connecting zones of said lifting arms to said vertically adjustable support frame.

8. A bed according to claim 7, said lifting arms comprising a first pair of fixedly interconnected parallel arms laterally spaced apart and pivotally mounted on a common axis, and a second pair of fixedly interconnected arms laterally spaced apart and pivotally mounted on a common axis spaced from said first-mentioned common axis, said second pair of arms being inclined toward one another to form a triangle or truncated triangle laterally strong brace arm arrangement, and said second pair of arms forming two pivotal connections adjacent laterally differently spaced apart zones of said arms.

9. A height-adjustable bed comprising a base, a vertically adjustable support frame vertically adjustable relative to said base, pivoted lifting arms pivotally connecting between said base and said vertically adjustable support frame, force application means for applying a lifting-movement-effecting torque to said pivoted lifting arms, said means for applying a lifting-movement-effecting torque including torque compensation means for applying a greater torque to said lifting arms in a lowered position than in a raised position of said lifting arms, said lifting arms comprising a first pair of fixedly interconnected parallel arms laterally spaced apart and pivotally mounted on a common axis, and a second pair of fixedly interconnected arms laterally spaced apart and pivotally mounted on a common axis spaced from said first-mentioned common axis, said second pair of arms being inclined toward one another to form a triangle or truncated triangle laterally strong brace arm arrangement, and said second pair of arms forming two pivotal connections adjacent laterally differently spaced apart zones of said arms.

10. A height-adjustable bed comprising a base, a vertically adjustable support frame vertically adjustable relative to said base, pivoted lifting arms pivotally connecting between said base and said vertically adjustable support frame, force application means for applying a lifting-movement-effecting torque to said pivoted lifting arms, said means for applying a lifting-movement-effecting torque including torque compensation means for applying a greater torque to said lifting arms in a lowered position than in a raised position of said lifting arms, said lifting arms connecting with said vertically adjustable support frame and said base in a pivoted parallelogram arrangement.

11. A bed according to claim 10, said connecting means further comprising a drag link, and means pivotally connecting said drag link at spaced positions at each of said lifting arms, said drag link forming a parallelogram segment of another pivoted parallelogram arrangement with said lifting arms and said vertically adjustable support frame.

12. A height-adjustable bed comprising a base, a vertically adjustable support frame vertically adjustable relative to said base, pivoted lifting arms pivotally connecting between said base and said vertically adjustable support frame, force application means for applying a lifting-movement-effecting torque to said pivoted lifting arms, said means for applying a lifting-movement-effecting torque including torque compensation means for applying a greater torque to said lifting arms in a lowered position than in a raised position of said lifting arms, said lifting arms forming a parallelogram linkage, and a cantilever wall bumper pivotally mounted on said base and movable between a raised longitudinally retracted position and a lowered longitudinally extended position, said wall bumper movable downwardly and longitudinally outwardly as a function of lowering of said vertically adjustable support frame and the pivotal angular lowering movement of said vertically adjustable support frame in the same general longitudinally outward direction as said bumper.

13. A bed according to claim 12, said wall bumper being engageable by means on said vertically adjustable support frame as a function of lowering of said vertically adjustable support frame.

14. A bed according to claim 12, said stop being positioned such that said wall bumper and lower stop means for said wall bumper, has a lowermost pivoted stop position in which its free cantilever end extends downwardly beneath the pivot point interconnection thereof with said base to effect self-holding retention in such downward position when pushed against a wall.

15. A bed according to claim 12, said wall bumper being generally U-shaped and pivotally connected to said base at the U-leg ends, and spaced plural wall engaging roller means on the free cantilever end of said wall bumber.

16. A bed according to claim 12, and wall-engaging roller means on the free cantilever end of said wall bumper.

17. A bed according to claim 12, said wall bumper being frictionally self-retained in a set pivoted position, and being frictionally resistively movable about said pivot connection with said base.

18. A height-adjustable bed comprising a base, a vertically adjustable support frame vertically adjustable relative to said base, pivoted lifting arms pivotally connecting between said base and said vertically adjustable support frame, force application means for applying a lifting-movement-effecting torque to said pivoted lifting arms, said means for applying a lifting-movement-effecting torque including torque compensation means for applying a greater torque to said lifting arms in a lowered position than in a raised position of said lifting arms, said force application means comprising an elevation drive screw and nut.

19. A bed according to claim 18, one of said elevation drive screw and nut being carried by and connected in thrust-opposing relation with said vertically adjustable support frame.

20. A bed according to claim 19, said torque compensation means comprising a pivotally mounted bell crank, and connecting means for connecting said bell crank in variable torque-transmitting relation between a power input means and said lifting arms.

21. A bed according to claim 20, said connecting means including a force-transmitting connection between one end of said bell crank and one of said lifting arms, and a second force-transmitting connection between another end of said bell crank and said power input means.

22. A bed according to claim 21,
said connecting means further comprising a drag link,
said bell crank being pivotally mounted on and carried by said drag link,
and means pivotally connecting said drag link at spaced positions at each of said lifting arms.

23. A bed according to claim 22,
said second force-transmitting connection comprising drive screw and nut.

24. A bed according to claim 23,
said drive screw and nut comprising a ball screw and ball nut,
mounting means on said vertically adjustable support frame for the rotatable one of said ball screw and nut,
and a one-way clutch and brake connecting between said ball screw and said mounting means.

25. A bed according to claim 19,
said drive screw and nut comprising a ball screw and ball nut,
mounting means on said vertically adjustable support frame for the rotatable one of said ball screw and nut,
and a one-way clutch and brake connecting between said ball screw and said mounting means.

26. A height-adjustable bed comprising
a base,
a vertically adjustable support frame vertically adjustable relative to said base,
pivoted lifting arms pivotally connecting between said base and said vertically adjustable support frame,
force application means for applying a lifting-movement-effecting torque to said pivoted lifting arms,
said means for applying a lifting-movement-effecting torque including torque compensation means for applying a greater torgue to said lifting arms in a lowered position than in a raised position of said lifting arms,
said lifting arms connecting with said vertically adjustable support frame and said base in a pivoted parallelogram arrangement,
and articulated mattress support means on said vertically adjustable support frame,
said vertically adjustable support frame being a subframe for said articulated mattress support means.

27. A bed according to claim 26,
said articulated mattress support means comprising a seat section pivotally mounted on said subframe, and head or back and thigh sections pivotally mounted on said seat section,
and pivot-effecting means for pivoting said seat section, and each of said back section and said thigh sections.

28. A bed according to claim 27,
said seat section comprising rocker means having two longitudinally spaced apart parallel pivot zones,
said pivot-effecting means comprising means for selectively pivoting said seat about each of said pivot zones.

29. A bed according to claim 28,
and coordinating movement means for moving said back or head section and said thigh section with said seat section during pivotal movement of said seat section.

30. A bed according to claim 29,
said coordinating movement means comprising cam and cam follower means connecting between said pivot-effecting means and said back section and said thigh section.

31. A height adjustable bed comprising
a base,
a vertically adjustable support frame vertically adjustable parallel to said base,
pivoted lifting arms pivotally connecting between said base and said vertically adjustable support frame,
force application means for applying a pivotal lifting movement effecting force to said pivoted lifting arms,
said lifting arms forming a parallelogram linkage,
and a wall bumper pivotally mounted on said base and movable between a raised longitudinally retracted position and a lowered longitudinally extended position,
said wall bumper movable downwardly and longitudinally outwardly as a function of lowering of said vertically adjustable support frame and the movement of said vertically adjustable support frame in the same general longitudinally outward direction as said bumper.

32. A bed according to claim 31,
said wall bumper being engageable by means on said vertically adjustable support frame as a function of lowering of said vertically adjustable support frame.

33. A bed according to claim 31,
said wall bumper having a lowermost pivoted position in which the free cantilever end extends downwardly beneath the pivot point interconnection thereof with said base to effect self-holding retention in such downward position when pushed against a wall.

34. A bed according to claim 33,
said wall bumper being engageable by means on said vertically adjustable support frame as a function of lowering of said vertically adjustable support frame.

35. A height adjustable bed comprising
a base,
a vertically adjustable support frame vertically adjustable relative to said base,
pivoted lifting arms pivotally connecting between said base and said vertically adjustable support frame,
force application means for applying a lifting-movement-effecting torque to said pivot lifting arms,
said lifting arms comprising
a first pair of fixedly interconnected arms laterally spaced apart and pivotally mounted on a common axis,
and a second pair of fixedly interconnected arms laterally spaced apart and pivotally mounted on a common axis spaced from said first-mentioned common axis,
said second pair of arms being inclined toward one another to form a triangle or truncated triangle laterally strong brace arm arrangement, and said second pair of arms forming two pivotal connections adjacent laterally differently spaced apart zones of said arms.

36. A bed according to claim 35,
said first pair of arms being generally parallel.

37. A bed according to claim 35,
said lifting arms connecting with said vertically adjustable support frame and said base in a pivoted parallelogram arrangement.

* * * * *